US008678389B1

(12) United States Patent
Ho

(10) Patent No.: US 8,678,389 B1
(45) Date of Patent: Mar. 25, 2014

(54) SHUFFLING MACHINE

(71) Applicant: Taiwan Fulgent Enterprise Co., Ltd., Taipei (TW)

(72) Inventor: Cai-Shiang Ho, Taipei (TW)

(73) Assignee: Taiwan Fulgent Enterprise Co., Ltd., Taipei (TW)

( * ) Notice: Subject to any disclaimer, the term of this patent is extended or adjusted under 35 U.S.C. 154(b) by 0 days.

(21) Appl. No.: 13/673,836

(22) Filed: Nov. 9, 2012

(51) Int. Cl.
*A63F 1/12* (2006.01)

(52) U.S. Cl.
USPC ..... 273/149 R

(58) Field of Classification Search
None
See application file for complete search history.

(56) References Cited

U.S. PATENT DOCUMENTS 1,014,219 A * 1/1912 Hall ..... 273/149 R
4,515,367 A * 5/1985 Howard ..... 273/149 R
5,584,483 A * 12/1996 Sines et al. ..... 273/149 R
6,655,684 B2 * 12/2003 Grauzer et al. ..... 273/149 R
7,029,109 B2 * 4/2006 Shirota et al. ..... 347/100
7,434,805 B2 * 10/2008 Grauzer et al. ..... 273/149 R
7,500,672 B2 * 3/2009 Ho ..... 273/149 R
7,523,935 B2 * 4/2009 Grauzer et al. ..... 273/149 R
7,753,374 B2 * 7/2010 Ho ..... 273/149 R
7,762,554 B2 * 7/2010 Ho ..... 273/149 R
7,933,444 B2 * 4/2011 Downs et al. ..... 382/141
8,070,574 B2 * 12/2011 Grauzer et al. ..... 463/11
8,118,305 B2 * 2/2012 Grauzer et al. ..... 273/149 R
8,170,323 B2 * 5/2012 Downs et al. ..... 382/141
8,342,525 B2 * 1/2013 Scheper et al. ..... 273/149 R
2012/0283025 A1 * 11/2012 Grauzer et al. ..... 463/43
2013/0099448 A1 * 4/2013 Scheper et al. ..... 273/309

* cited by examiner

*Primary Examiner* — Kurt Fernstrom
*Assistant Examiner* — Dolores Collins
(74) *Attorney, Agent, or Firm* — Muncy, Geissler, Olds & Lowe, P.C.

(57) ABSTRACT

A card output device of a shuffling machine, the device comprising a base comprising a first and a second side walls, a roller assembly rotatably mounted between the first and second side walls of the base, the roller assembly comprising a first set of rollers, and a second set of rollers arranged over the first set of rollers, the second set of rollers being moved upwards and downwards between the first and second side walls of the base, and a receiver detachably mounted to the base.

22 Claims, 29 Drawing Sheets

SHUFFLING MACHINE

BACKGROUND OF THE INVENTION

The present invention generally relates to a shuffling machine, and more particularly, to an automatic shuffling machine.

A general shuffling machine has a lot of motors to provide driving force to the mechanism resided in the shuffling machine. However, the greater number of the motors means more power consumption. Moreover, some shuffling machines have complex structure that may easily cause malfunction of the shuffling machine.

It may therefore be desirable to have a shuffling machine that consumes less power and has a simpler structure.

BRIEF SUMMARY OF THE INVENTION

Examples of the present invention may provide a card output device of a shuffling machine, the device comprising a base comprising a first and a second side walls, a roller assembly rotatably mounted between the first and second side walls of the base, the roller assembly comprising a first set of rollers; and a second set of rollers arranged over the first set of rollers, the second set of rollers being moved upwards and downwards between the first and second side walls of the base, a first gear assembly rotatably mounted on the first side wall of the base, the first gear assembly comprising a first gear coupled to the first set of rollers, a second gear coupled to the second set of rollers, a third gear engaged with the first gear, and a fourth gear engaged with the second gear and the third gear, and a second gear assembly rotatably mounted on the second side wall of the base, the second gear assembly comprising a first gear coupled to the fourth gear of the first gear assembly, and a second gear engaged with the first gear and coupled to the second set of rollers.

Some examples of the present invention may provide a card output device of a shuffling machine, the device comprising a base comprising a first and a second side walls, a roller assembly rotatably mounted between the first and second side walls of the base, the roller assembly comprising a first set of rollers, and a second set of rollers arranged over the first set of rollers, the second set of rollers being moved upwards and downwards between the first and second side walls of the base, and a receiver detachably mounted to the base.

Other examples of the present invention may provide a card output device of a shuffling machine, the device comprising a base comprising a first and a second side walls, a roller assembly rotatably mounted between the first and second side walls of the base, the roller assembly comprising a first set of rollers; and a second set of rollers arranged over the first set of rollers, the second set of rollers being moved upwards and downwards between the first and second side walls of the base, a first gear assembly rotatably mounted on the first side wall of the base, the first gear assembly comprising a first gear coupled to the first set of rollers, a second gear coupled to the second set of rollers, a third gear engaged with the first gear, and a fourth gear engaged with the second gear and the third gear, a second gear assembly rotatably mounted on the second side wall of the base, the second gear assembly comprising a first gear coupled to the fourth gear of the first gear assembly, and a second gear engaged with the first gear and coupled to the second set of rollers, and a receiver detachably mounted to the base.

Additional features and advantages of the present invention will be set forth in portion in the description which follows, and in portion will be obvious from the description, or may be learned by practice of the invention. The features and advantages of the invention will be realized and attained by means of the elements and combinations particularly pointed out in the appended claims.

It is to be understood that both the foregoing general description and the following detailed description are exemplary and explanatory only and are not restrictive of the invention as claimed

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, examples are shown in the drawings. It should be understood, however, that the invention is not limited to the precise arrangements and instrumentalities shown in the examples.

In the drawings.

DETAILED DESCRIPTION OF THE INVENTION

Reference will now be made in detail to the present examples of the invention, examples of which are illustrated in the accompanying drawings. Wherever possible, the same reference numbers will be used throughout the drawings to refer to the same or like parts.

Figure 1:
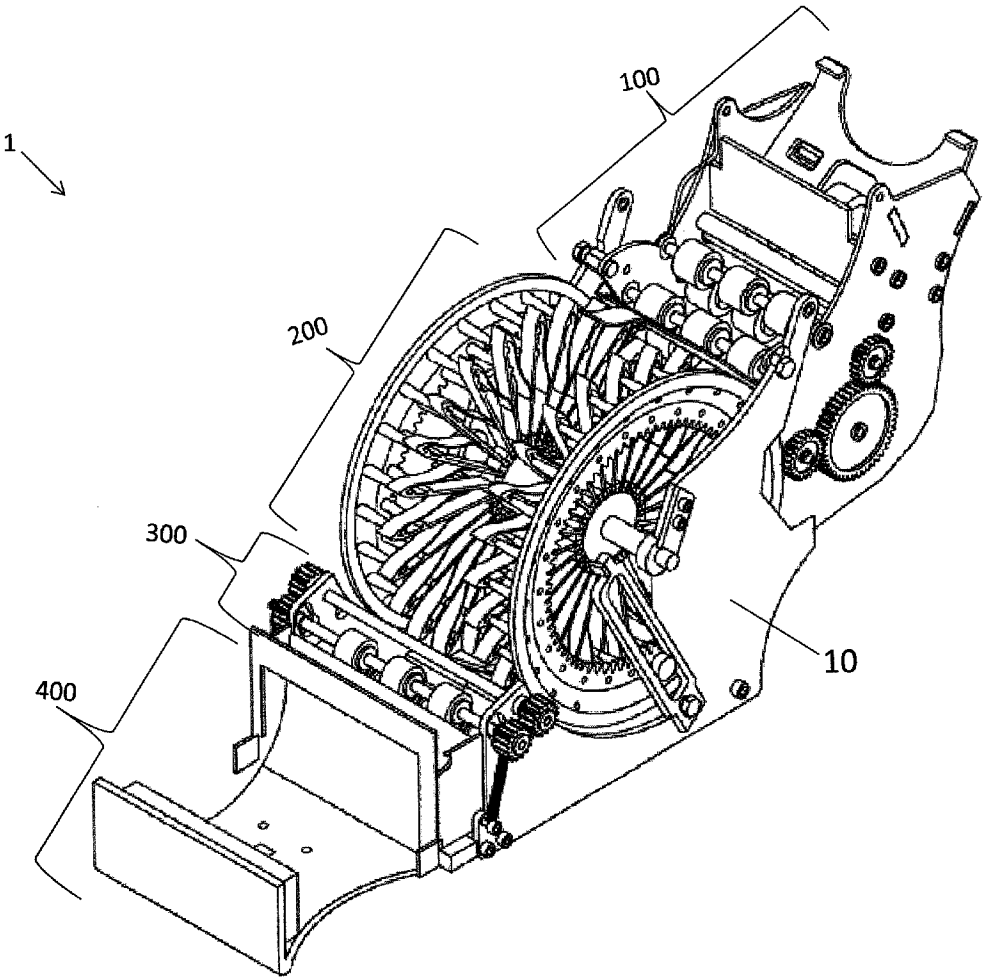
FIG. 1 is a perspective view of the shuffling machine in accordance with an example of the present invention.

FIG. 1 is a perspective view of the shuffling machine 1 in accordance with an example of the present invention. Referring to FIG. 1, the shuffling machine 1 may include a card input device 100, a shuffling device 200, a card output device 300 and a card receiver 400. The shuffling machine 1 may further include a base 10 adapted to support the shuffling machine 1. The card input device 100 may be detachably mounted to the base 10 of the shuffling machine 1. Furthermore, the shuffling device 200 may be mounted to the base 10 adjacent to the card input device 100. Moreover, the card output device 300 may be securely mounted to the base 10 adjacent to the shuffling device 200 opposite to the card input device 100. In addition, the card receiver 400 may be detachably mounted to the base 10 adjacent to the card output device 300.

Specifically, the card input device 100 may be adapted to receive a stack of cards A. Furthermore, the card output device 300 may be adapted to receive cards shuffled by and discharged from the shuffling device 200. Moreover, the card receiver 400 may be adapted to receive the cards from the card output device 300.

Figure 2A:
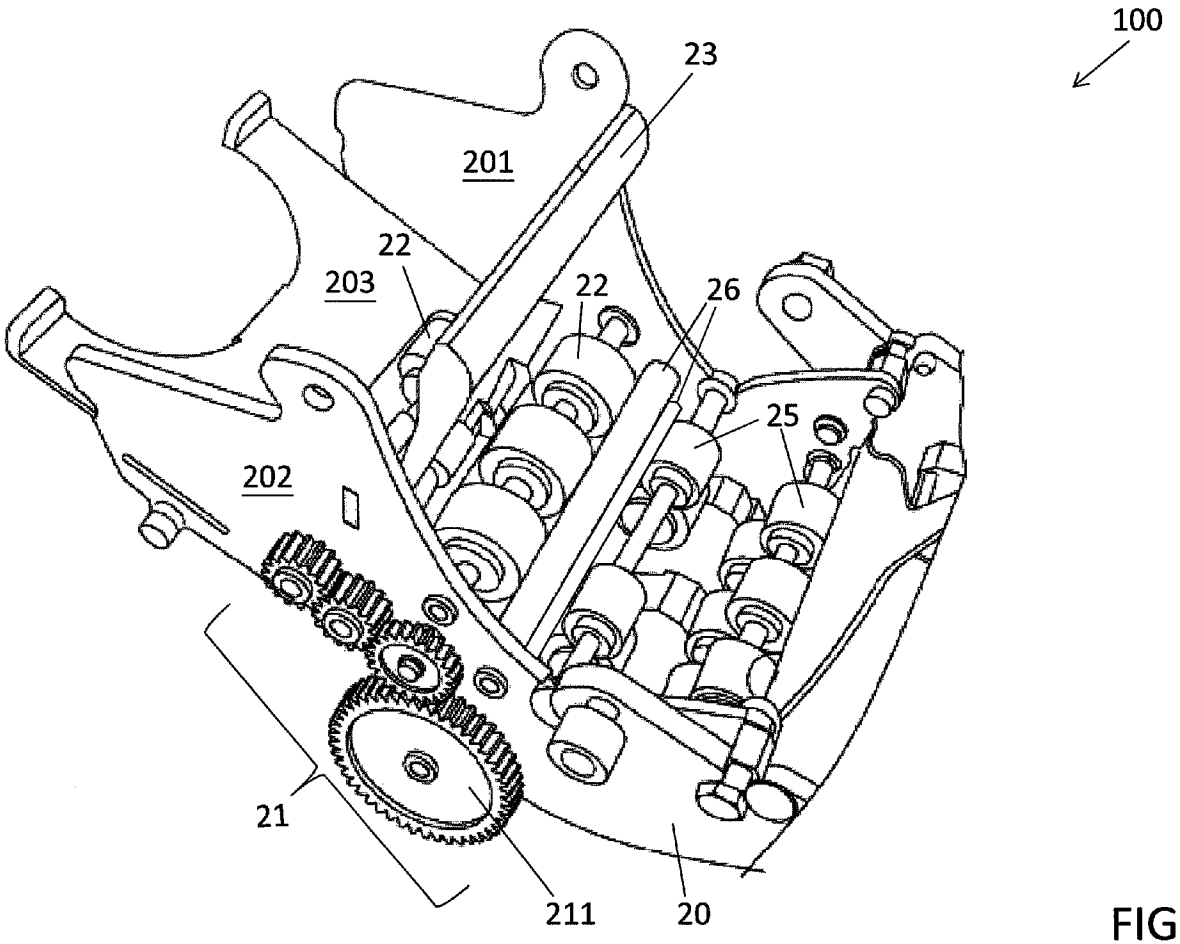
FIG. 2A is a perspective view of the card input device as illustrated in FIG. 1 in accordance with an example of the present invention.
Figure 2B:
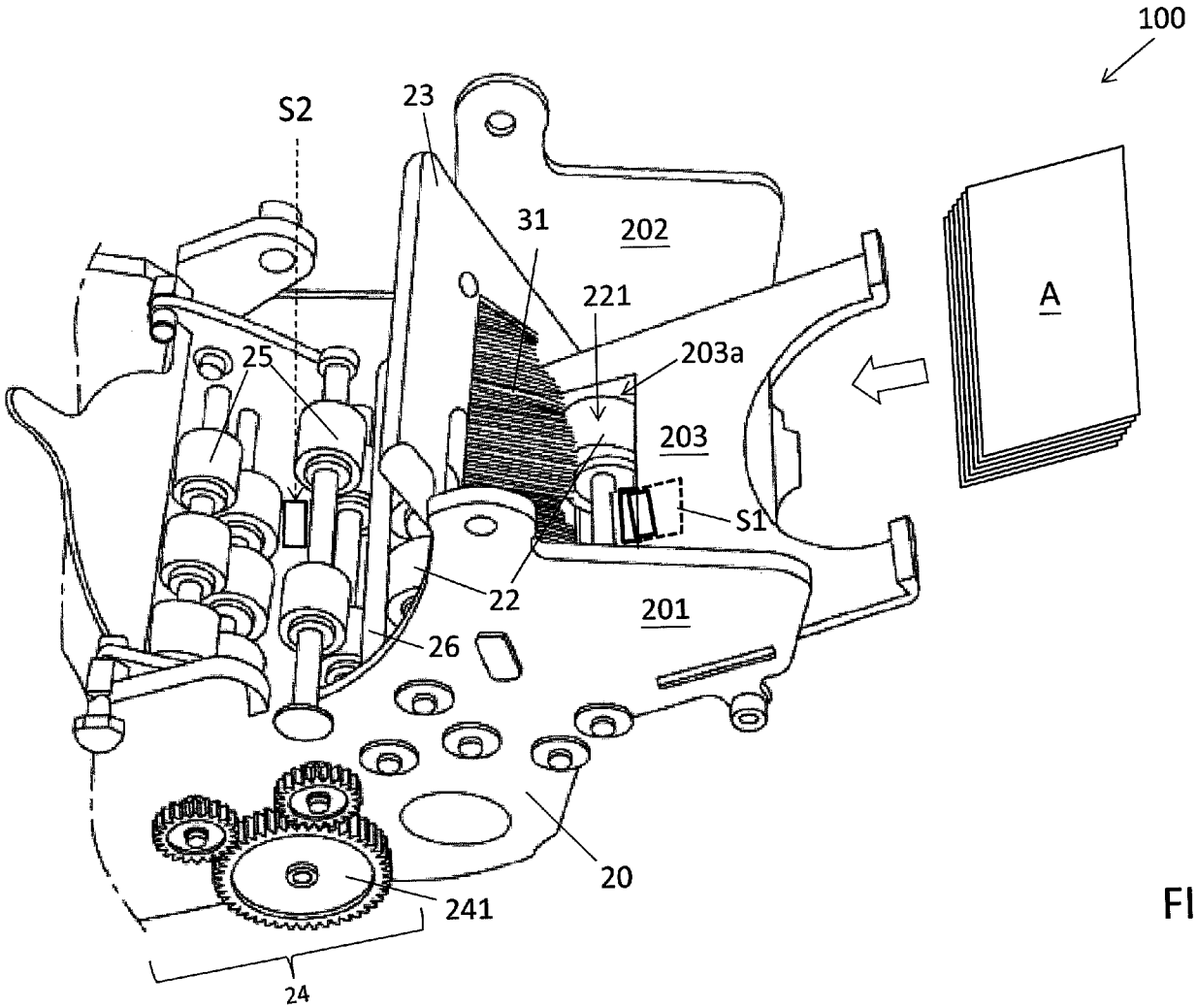
FIG. 2B is another perspective view of the card input device from a different angle as illustrated in FIG. 2A in accordance with an example of the present invention.

FIG. 2A is a perspective view of the card input device 100 as illustrated in FIG. 1, and FIG. 2B is another perspective view of the card input device 100 from a different angle as illustrated in FIG. 2A in accordance with an example of the present invention. Referring to FIGS. 2A and 2B, the card input device 100 may include a body 20, a gear assembly 21, a roller assembly 22 associated with the gear assembly 21, a filtering mechanism 23, a gear assembly 24 and a roller assembly 25 associated with the gear assembly 24. The card input device 100 may further include a pair of bars 26.

Referring to FIG. 2A, the body 20 of the card input device 100 may include a pair of side walls 201 and 202 and a receiving plate 203 detachably mounted between the side walls 201 and 202. The side walls 201 and 202 and the receiving plate 203 may form an open (not shown) for receiving the stack of cards A. Furthermore, the gear assembly 21 may include at least four gears each of which may be rotatably mounted to the side wall 202. The at least four gears may be engaged with one another. One of the gears of the gear assembly 21, for example, the gear 211 may be coupled to and driven by a motor (not shown), such that the gear 211 may serve as a driving gear to drive other gears of the gear assembly 21. Moreover, the roller assembly 22 may include at least three sets of rollers each of which may be rotatably mounted between the side walls 201 and 202. The roller assembly 22 may be coupled to and driven by the gear assembly 21, such that the roller assembly 22 may be adapted to transmit the cards to the shuffling device 200.

Referring to FIG. 2B, a hole 203*a* may be formed in the receiving plate 203 of the body 20 to expose a set of rollers 221 of the roller assembly 22. Accordingly, a card which is accommodated in the card input device 100 and in contact with the rollers 221 can be moved toward the filtering mechanism 23. Furthermore, a sensor S1 may be disposed on the lower surface of the receiving plate 203. Portion of the sensor S1 may be exposed by the hole 203*a*, so that the card accommodated on the upper surface of the receiving plate 203 may be detected by the sensor S1.

The filtering mechanism 23 may be detachably mounted between the side walls 201 and 202 over the roller assembly 22. The filtering mechanism 23 may be adapted to filter the cards so that only one of the cards each time can pass the filtering mechanism 23.

Furthermore, similar to the gear assembly 21, the gear assembly 24 may include at least three gears each of which may be rotatably mounted on the side wall 201. The at least three gears may be engaged with one another. One of the gears of the gear assembly 24, for example, the gear 241 may be coupled to and driven by a motor (not shown), such that the gear 241 may serve as a driving gear to drive the other gears of the gear assembly 24. Moreover, similar to the roller assembly 22 in the present example, the roller assembly 25 may include at least four sets of rollers and each of which may be rotatably mounted between the side walls 201 and 202. The roller assembly 25 may be coupled to and driven by the gear assembly 24, such that the roller assembly 25 may be adapted to transmit the card from the filtering mechanism 23 to the shuffling device 200.

In the present example, a sensor S2 may be disposed on the inner surface of the side wall 202 of the body 20 beside the roller assembly 25. Each card of the stack of cards A which may be transmitted by the roller assembly 25 may be detected by the sensor S2. Accordingly, the sensor S2 may be configured to count the number of cards transmitted by the roller assembly 25. In another example, the sensor S2 may be disposed on the inner surface of the side wall 201 beside the roller assembly 25.

Figure 3A:
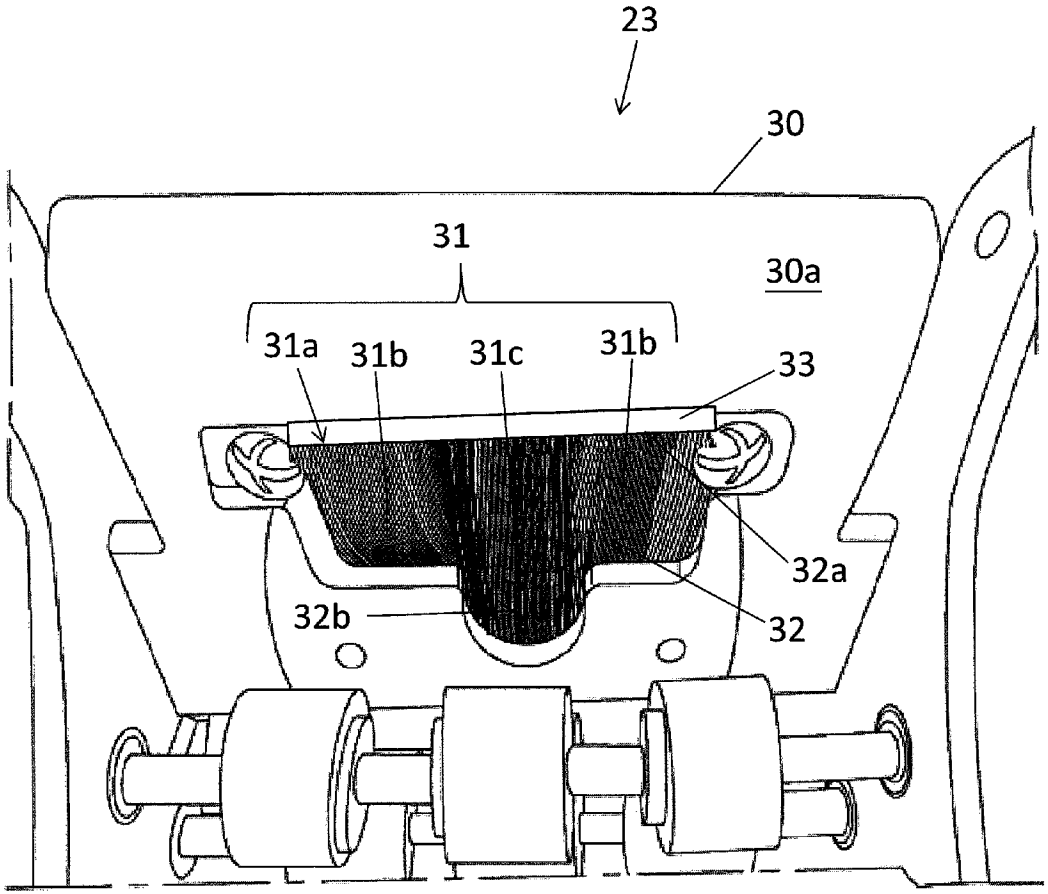
FIG. 3A is a rear view of the filtering mechanism as illustrated in FIGS. 2A and 2B in accordance with an example of the present invention.
Figure 3B:
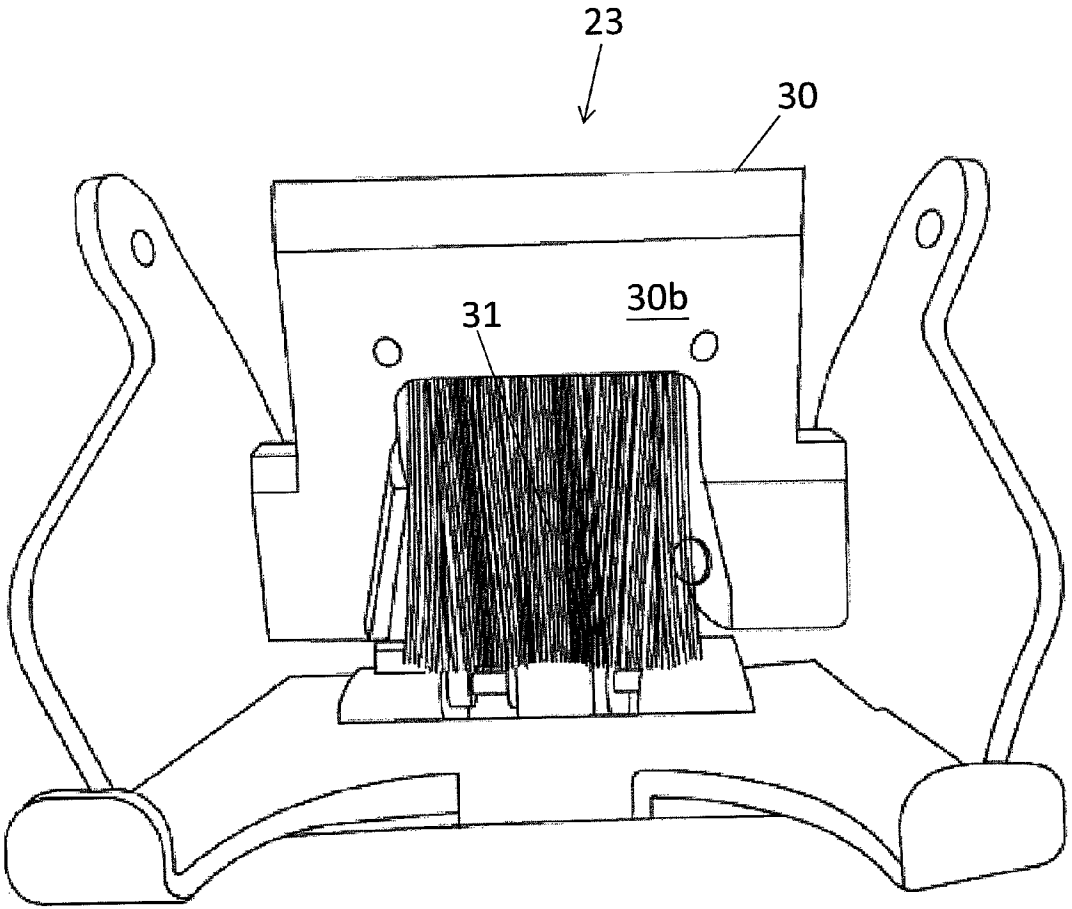
FIG. 3B is a front view of the filtering mechanism as illustrated in FIGS. 2A and 2B in accordance with an example of the present invention.

FIG. 3A is a rear view and FIG. 3B is a front view of the filtering mechanism 23 as illustrated in FIGS. 2A and 2B in accordance with an example of the present invention. Referring to FIG. 3A, the filtering mechanism 23 may include a plate 30 and a brush 31 which is detachably mounted to the plate 30 through a connecting mechanism 33. Specifically, a open 32, which may have a rectangular shape in the present example, may be formed in the plate 30 and the connecting mechanism 33 may be disposed close to the upper edge 32*a* of the open 32. In another example, the connecting mechanism 33 may be arranged on the back side 30*a* of the plate 30, and the brush 31 may be arranged to pass through the open 32 and extend toward the front side 30*b* of the plate 30, which is better illustrated in FIG. 3B. Parts of the brush 31 may be in contact with the rollers 221 as illustrated in FIG. 2B.

Referring back to FIG. 3A, an open 32*b*, which is a part of the open 32, may be further formed in and extended toward the bottom of the plate 30. In the present example, the open 32*b* may have a round or semicircular shape and may be extended from the center of the bottom of the open 32. Accordingly, the side parts 31*b* and the center part 31*c* of the brush 31 may be staggered. Thanks to the above arrangement, only one of the cards can be transmitted to the shuffling device 200 each time.

Figure 4A:
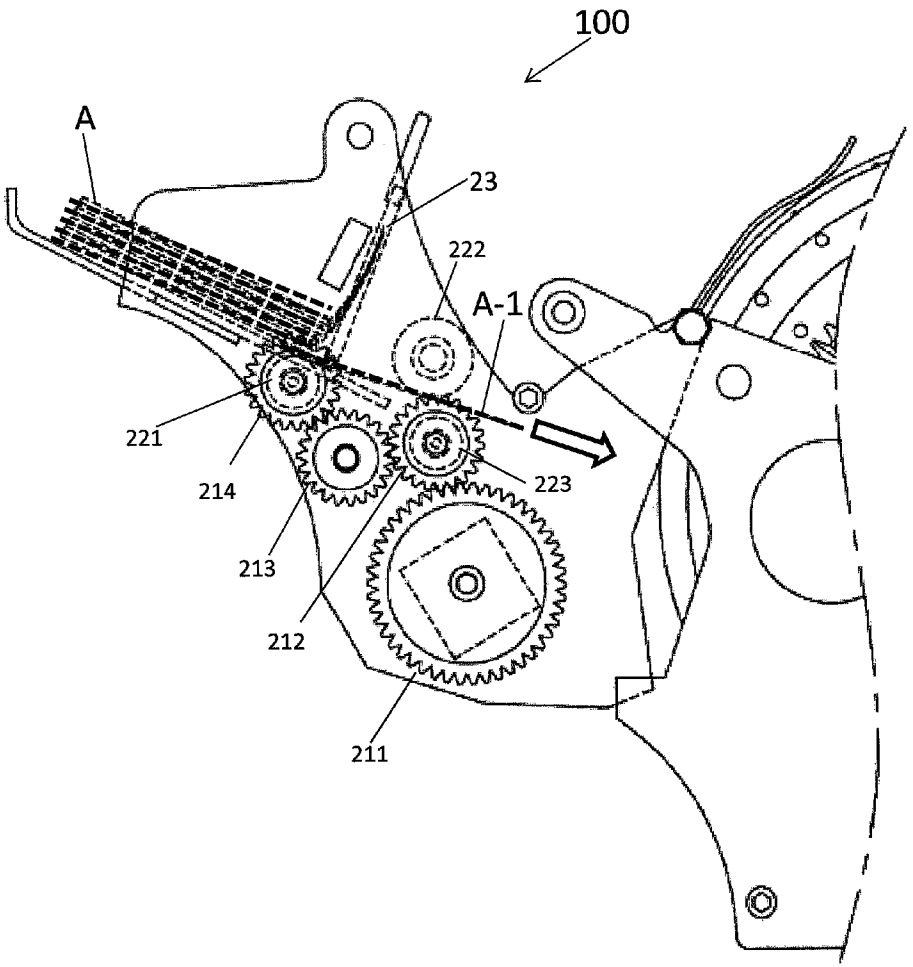
FIG. 4A is a right side view of the card input device as illustrated in FIGS. 2A and 2B in accordance with an example of the present invention.
Figure 4B:
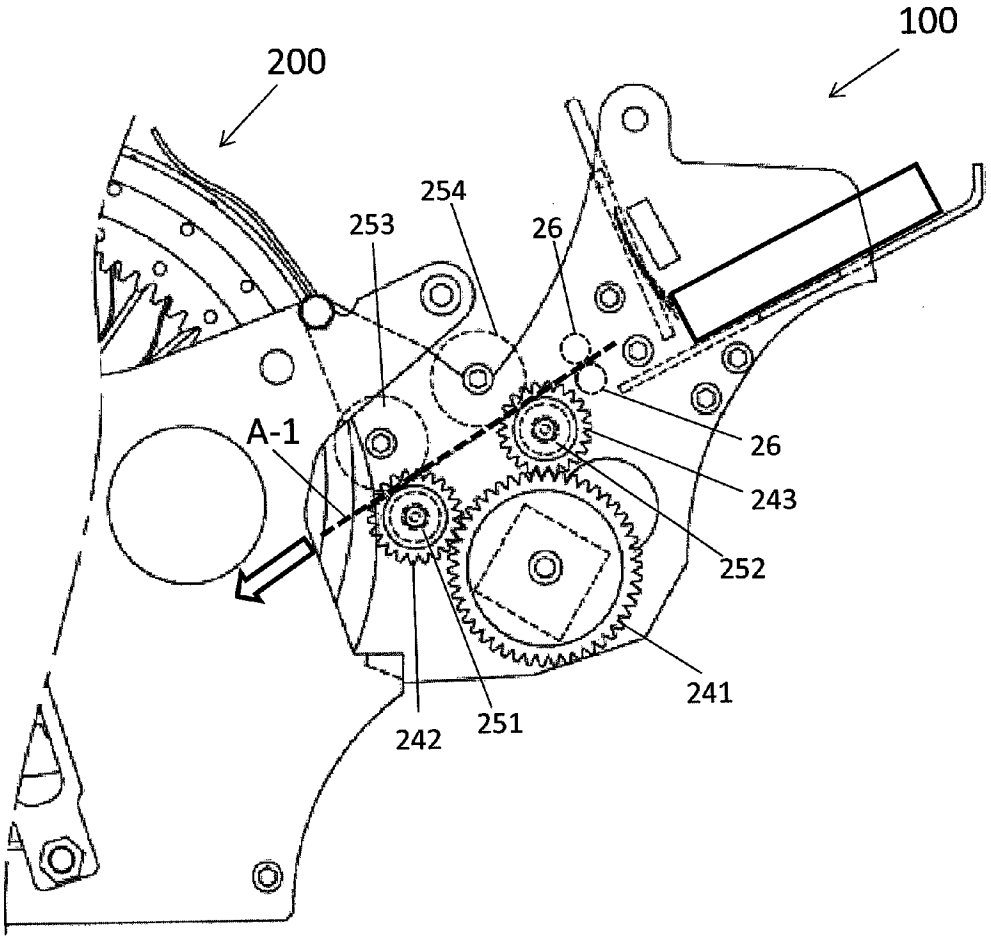
FIG. 4B is a left side view of the card input device as illustrated in FIGS. 2A and 2B in accordance with an example of the present invention.

FIG. 4A is a right side view and FIG. 4B is a left side view of the card input device 100 as illustrated in FIGS. 2A and 2B in accordance with an example of the present invention. An example of the operation of the card input device 100 is shown in FIGS. 4A and 4B. Referring to FIG. 4A, the bottom card A-1 of the cards A which are accommodated in the card input device 100 may be moved by the rollers 221 and in turn pass the filtering mechanism 23. Then, the card A-1 may then be transmitted by the sets of rollers 222 and 223. Specifically, in the present example as shown in FIG. 4A, the driving gear 211 may be counterclockwise rotated so that the gears 212 and 214 may be driven to rotate clockwise. Accordingly, the sets of rollers 221 and 223 driven by the gears 214 and 212 respectively may rotate clockwise. Furthermore, the set of rollers 222 may rotate counterclockwise and the card A-1 may pass through a space between the set of rollers 222 and the set of rollers 223. In this manner, the sets of rollers 221 to 223 may be adapted to transmit the card A-1 to pass through a space between the bars 26 and in turn to the roller assembly 25.

Still referring to FIG. 4B, the driving gear 241 may rotate clockwise, so that the gears 242 and 243 may be driven to rotate counterclockwise. Accordingly, the sets of rollers 251 and 252 driven by the gears 242 and 243 respectively may rotate counterclockwise. Furthermore, the sets of rollers 253 and 254 may rotate clockwise. With the above arrangement, the card A-1 may pass through a space between the rollers 252 and 254 and in turn a space between the rollers 251 and 253. Accordingly, the rollers 251, 252, 253 and 254 may be adapted to transmit the card A-1 to the shuffling device 200.

Figure 4C:
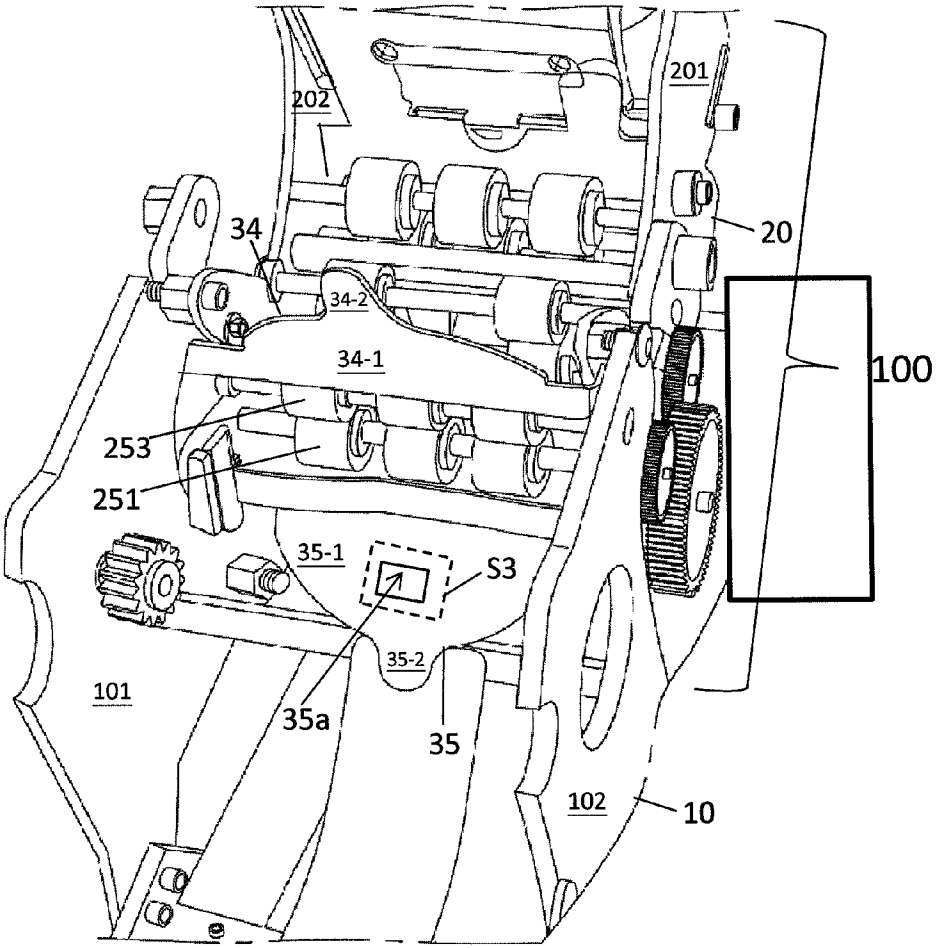
FIG. 4C is another perspective view of the card input device from a different angle as illustrated in FIGS. 2A and 2B in accordance with an example of the present invention.

FIG. 4C is another perspective view of the card input device 100 from a different angle as illustrated in FIGS. 2A and 2B in accordance with an example of the present invention. Referring to FIG. 4C, the card input device 100 may further include a pair of blocking plates 34 and 35 detachably mounted to the side walls 201 and 202 of the body 20 of the card input device 100. The pair of blocking plates 34 and 35 may be disposed adjacent to the rollers 251 and 253. Specifically, the blocking plate 34 may have a first portion 34-1 and a second portion 34-2. In the present example, the first portion 34-1 may have a semicircular shape, and the second portion 34-2 may be extended from the center of the upper edge of the first portion 34-1. Furthermore, the blocking plate 35 may have the same shape as the blocking plate 34, and the blocking plate 35 may be disposed in a symmetrical manner with respect to the blocking plate 34. In other words, the first portion 35-1 of the blocking plate 35 may also have a semicircular shape, and the second portion 35-2 of the blocking plate 35 may be extended from the center of the lower edge of the first portion 35-1. Moreover, a space between the blocking plates 34 and 35 may expose the rollers 251 and 253. Accordingly, the card A-1 which may be transmitted by the rollers 251 and 253 may pass through the space between the blocking plates 34 and 35.

In another example of the present invention, the blocking plates 34 and 35 may be detachably mounted to the side walls 101 and 102 of the base 10 and disposed adjacent to the shuffling device 200.

Figure 5A:
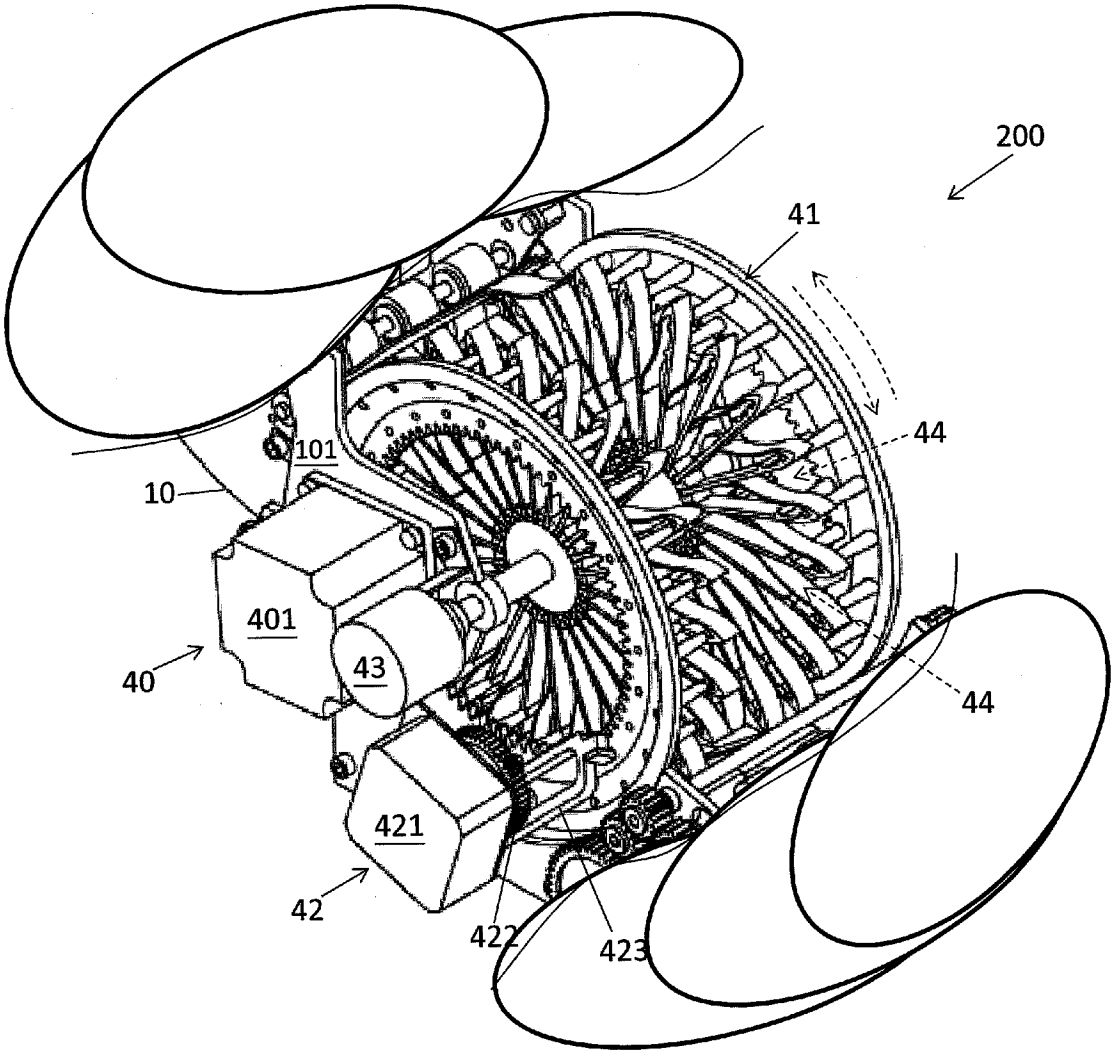
FIG. 5A is a perspective view of the shuffling device as illustrated in FIG. 1 in accordance with an example of the present invention.

FIG. 5A is a perspective view of the shuffling device 200 as illustrated in FIG. 1 in accordance with an example of the present invention. Referring to FIG. 5A, in the present example, the shuffling device 200 may include a driving assembly 40, a shuffling wheel 41 and a discharging assembly 42. In another example, the shuffling device 200 may further include an optical coder 43.

Specifically, the shuffling wheel 41 may include a plurality of compartments 44 adapted to receive and store cards transmitted from the roller assembly 25 of the card input device 100. Furthermore, the driving assembly 40 may include a motor 401 and a gear (not shown in FIG. 5A). The motor 401 may be coupled to the gear and configured to drive the gear. The shuffling wheel 41 may be driven by the gear so as to rotate clockwise or counterclockwise and thereby shuffle the cards stored in the compartments 44. Moreover, the discharging assembly 42 may include a motor 421, a gear 422 and a discharging rod 423. The motor 421 may be coupled to the gear 422 and configured to drive the gear 422. The discharging rod 423 may be driven by the gear 422 to pivotally move, such that the discharging rod 423 may push or discharge the cards from the compartments 44 of the shuffling wheel 41. The discharged cards may then be transmitted to the card output device 300.

Figure 5B:
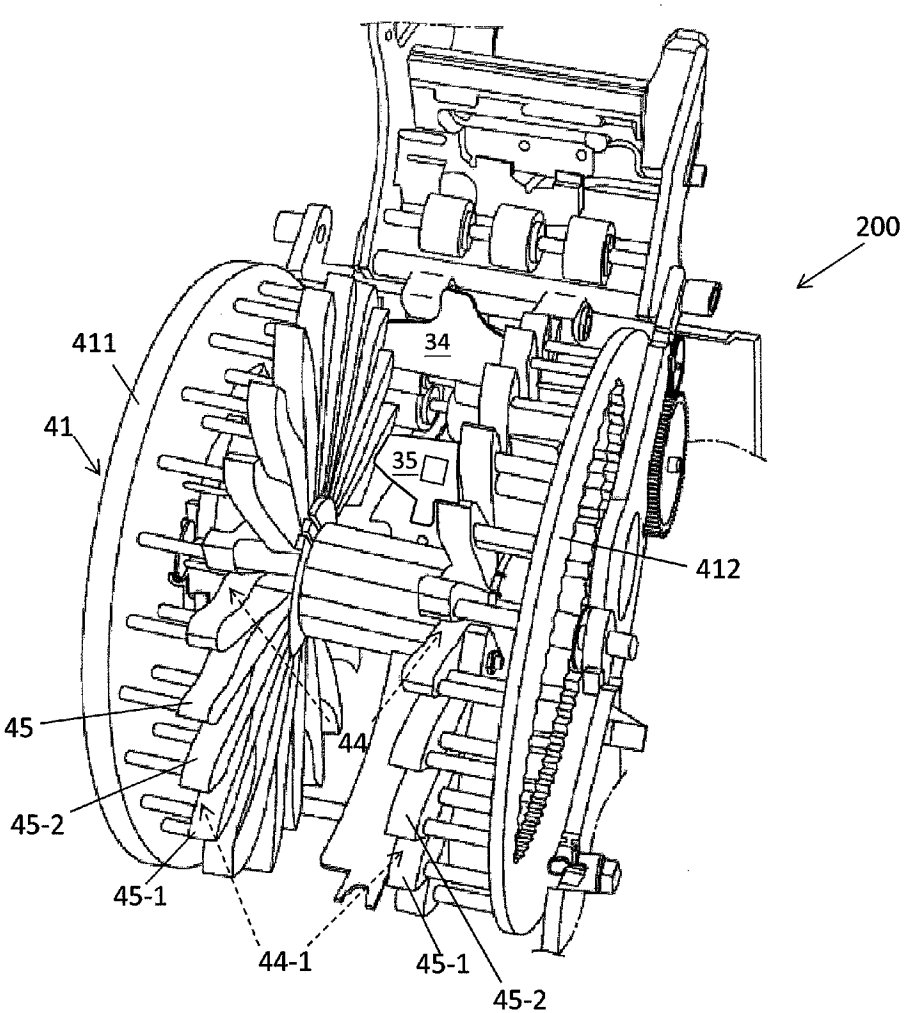
FIG. 5B is another perspective view of the shuffling device from a different angle as illustrated in FIG. 5A in accordance with an example of the present invention.

FIG. 5B is another perspective view of the shuffling device 200 from a different angle as illustrated in FIG. 5A in accordance with an example of the present invention. Referring to FIG. 5B, the shuffling wheel 41 may include a first portion 411 and a second portion 412. A plurality of retainers 45 may be securely mounted to the first portion 411 and the second portion 412 of the shuffling wheel 41. Each of the compartments 44 may be defined by two pairs of retainers 45. For example, one 44-1 of the compartments 44 may be defined by a pair of retainers 45-1 and a pair of retainers 45-2 adjacent to the retainers 45-1. Furthermore, the pair of blocking plates 34 and 35 may facilitate the cards to be completely inserted into each of the counterparts 44.

Figure 5C:
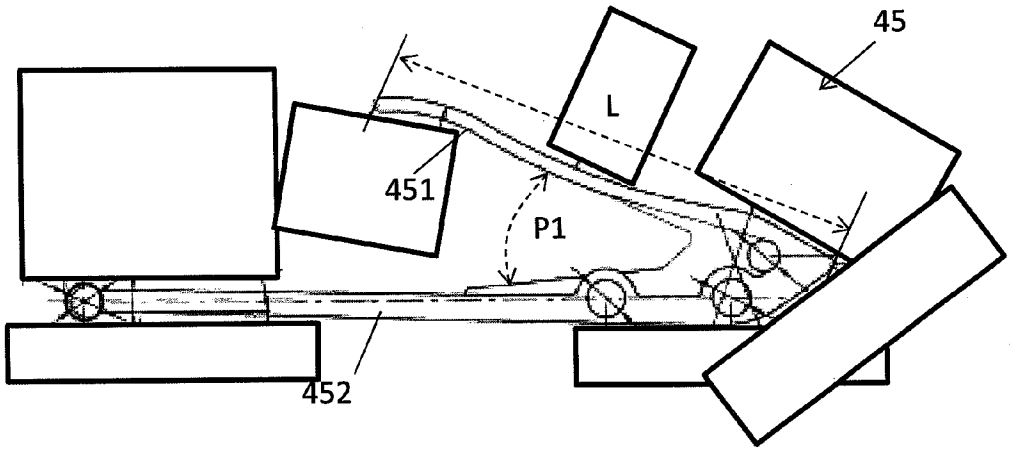
FIG. 5C is a right side view of the retainer as illustrated in FIG. 5B in accordance with an example of the present invention.
Figure 5D:
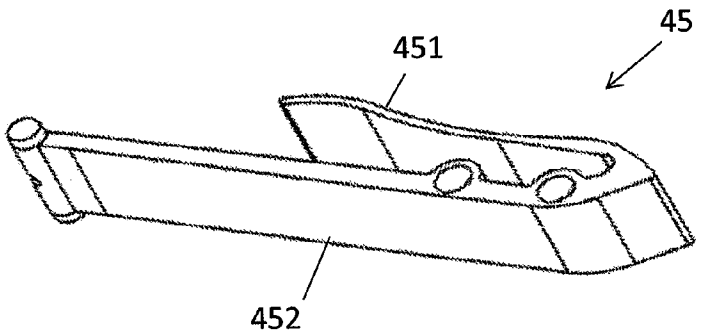
FIG. 5D is a perspective view of the retainer as illustrated in FIG. 5B in accordance with an example of the present invention.

FIG. 5C is a right side view and FIG. 5D is a perspective view of the retainer 45 as illustrated in FIG. 5B in accordance with an example of the present invention. Referring to FIGS. 5C and 5D, the retainer 45 may, for example, have a resilient portion 451 and a frame portion 452. The resilient portion 451 may be formed by bending and thinning the frame portion 452 at an acute angle P1. The resilient portion 451 may have a predefined length L which may be smaller than the length of the frame portion 452. In the present example, the resilient portion 451 may have a arc shape, and the frame portion 452 may have a straight shape.

Figure 5E:
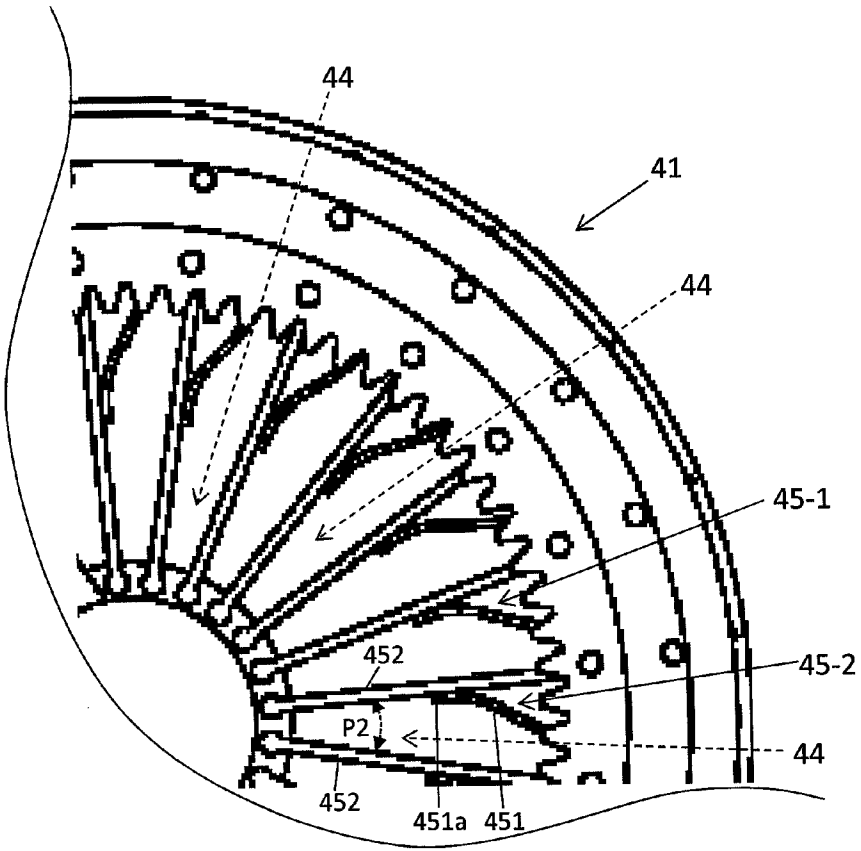
FIG. 5E is a right side view of parts of the shuffling wheel as illustrated in FIG. 5A in accordance with an example of the present invention.

FIG. 5E is a right side view of parts of the shuffling wheel 41 as illustrated in FIG. 5A in accordance with an example of the present invention. Referring to FIG. 5E, each compartment 44 of the shuffling wheel 41 may be defined by two frame portions 452 of two adjacent retainers 45-1 and 45-2. The angle P2 between two frame portions 452 of the two adjacent retainers 45-1 and 45-2 may depend on the number of the compartments 44 of the shuffling wheel 41. For example, if the shuffling wheel 41 includes thirty compartments 44, P2 may be twelve degrees. In another example, if the shuffling wheel 41 includes forty compartments 44, P2 may be nine degrees. The number of compartments 44 may be changed and varied as long as the angle P2 is an integer.

Furthermore, the end portion 451*a* of the resilient portion 451 of the retainer 45-2 may be in contact with the frame portion 452 of the adjacent retainer 45-1. Accordingly, if any card(s) is inserted into a compartment 44, the resilient force between the frame portion 452 and the resilient portion 451 may hold the card(s) tight in the compartment 44. In the present example, the material of the retainers 45, the angle P1 between the resilient portion 451 and the frame portion 452 of each retainer 45, and the length L of the resilient portion 451 may be appropriately selected, so that the resilient force between the frame portion 452 and the resilient portion 451 may be large enough to hold the card(s) tight in the compartment 44 without aid of any external element (such as a spring disposed between the resilient portion 451 and the frame portion 452).

Figure 5F:
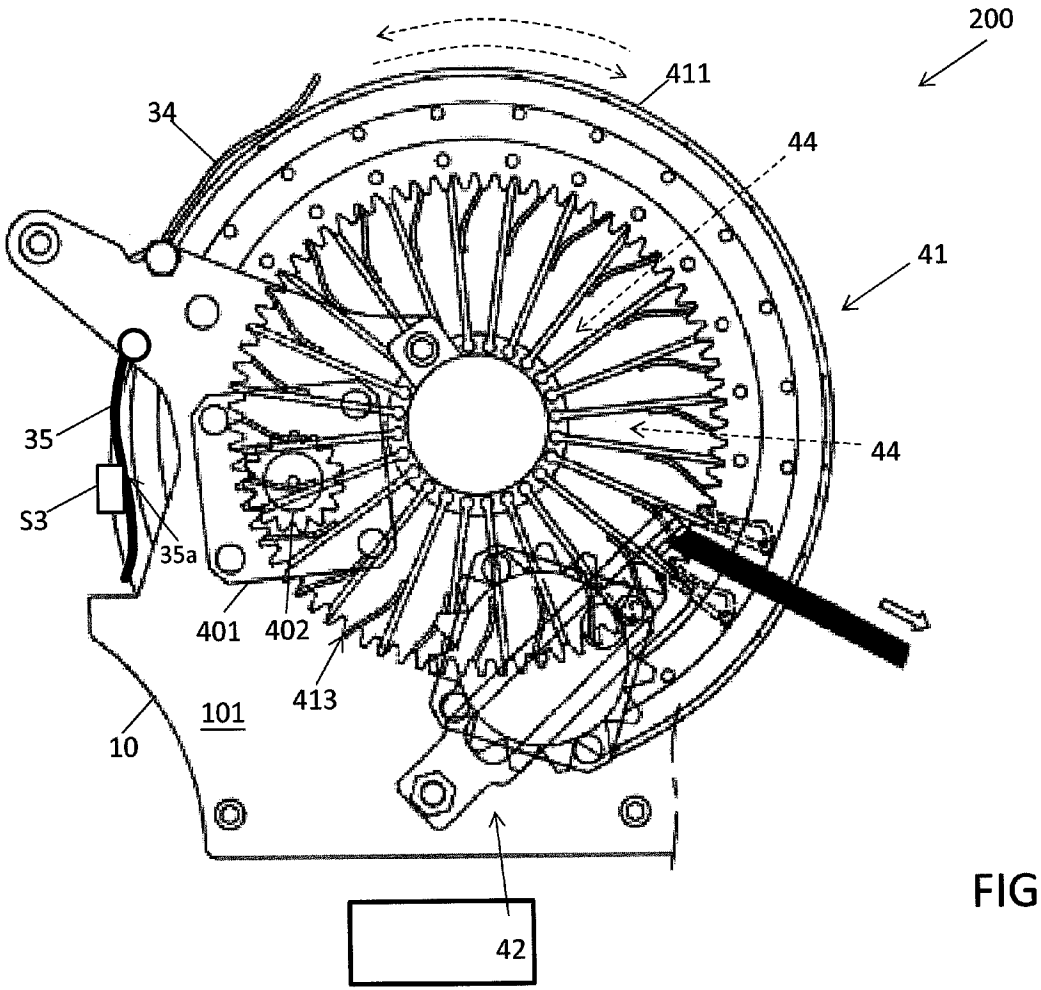
FIG. 5F is a right side view of the shuffling device as illustrated in FIG. 5A in accordance with an example of the present invention.

FIG. 5F is a right side view of the shuffling device 200 as illustrated in FIG. 5A in accordance with an example of the present invention. Referring to FIG. 5F, the motor 401 may be mounted to the side wall 101 of the base 10, and the gear 402 may be coupled to and driven by the motor 401 to serve as a driving gear. The driving gear 402 may be engaged with a plurality of teeth 413 formed on the inner rim of the first portion 411 of the shuffling wheel 41. In another example, the motor 401 may be mounted to the side wall 102 (not shown in FIG. 5F) of the base 10, so that the driving gear 402 may be engaged with a plurality of teeth formed on the inner rim of the second portion 412 (not shown in FIG. 5F) of the shuffling wheel 41. Accordingly, the shuffling wheel 41 may be rotated by the driving gear 402. In operation, the shuffling wheel 41 may be rotated clockwise or counterclockwise so as to shuffle the cards stored in the compartments 44.

In the present example, a sensor S3 may be disposed on a surface (i.e., the surface facing opposite to the shuffling wheel 41) of the blocking plate 35. Referring back to FIG. 4C, the sensor S3 may be exposed by a hole 35*a* formed in the blocking plate 35. Referring back to FIG. 5F, as the shuffling wheel 41 rotates so that one of the compartments 44 passes through a position aligned with the hole 35*a*, cards stored in the one compartment 44 may be detected by the sensor S3. Therefore, when the shuffling machine 1 initially powers on and the shuffling wheel 41 rotates by a complete round, the sensor S3 may be configured to detect whether any cards are stored in any compartments 44 of the shuffling wheel 41. If confirmative, the discharging assembly 42 may be configured to discharge all the cards from the shuffling wheel 41. In another example, the sensor S3 may be disposed on the blocking plate 34.

Referring back to FIG. 5A, the optical coder 43 may be detachably mounted to the side wall 101 of the base 10. Specifically, the optical coder 43 may be aligned with an axis along which the shuffling wheel 41 rotates. In this manner, the optical coder 43 may be programmed to facilitate controlling of the rotation of the shuffling wheel 41. In another example, the optical coder 43 may be detachably mounted to the shuffling wheel and aligned with the axis of the wheel 41.

Figure 6A:
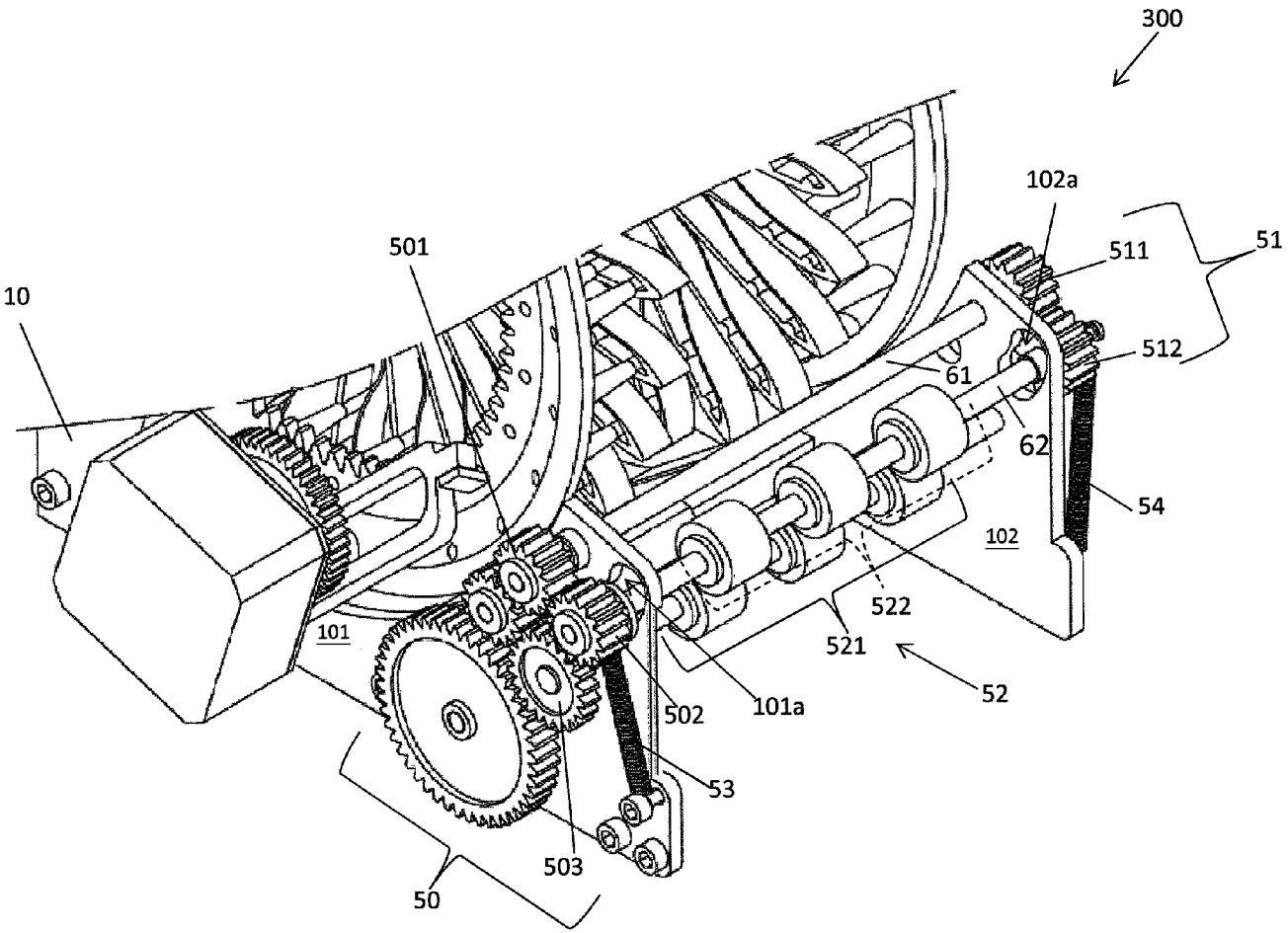
FIGS. 6A and 6B are perspective views of the card output device as illustrated in FIG. 1 in accordance with an example of the present invention.
Figure 6B:
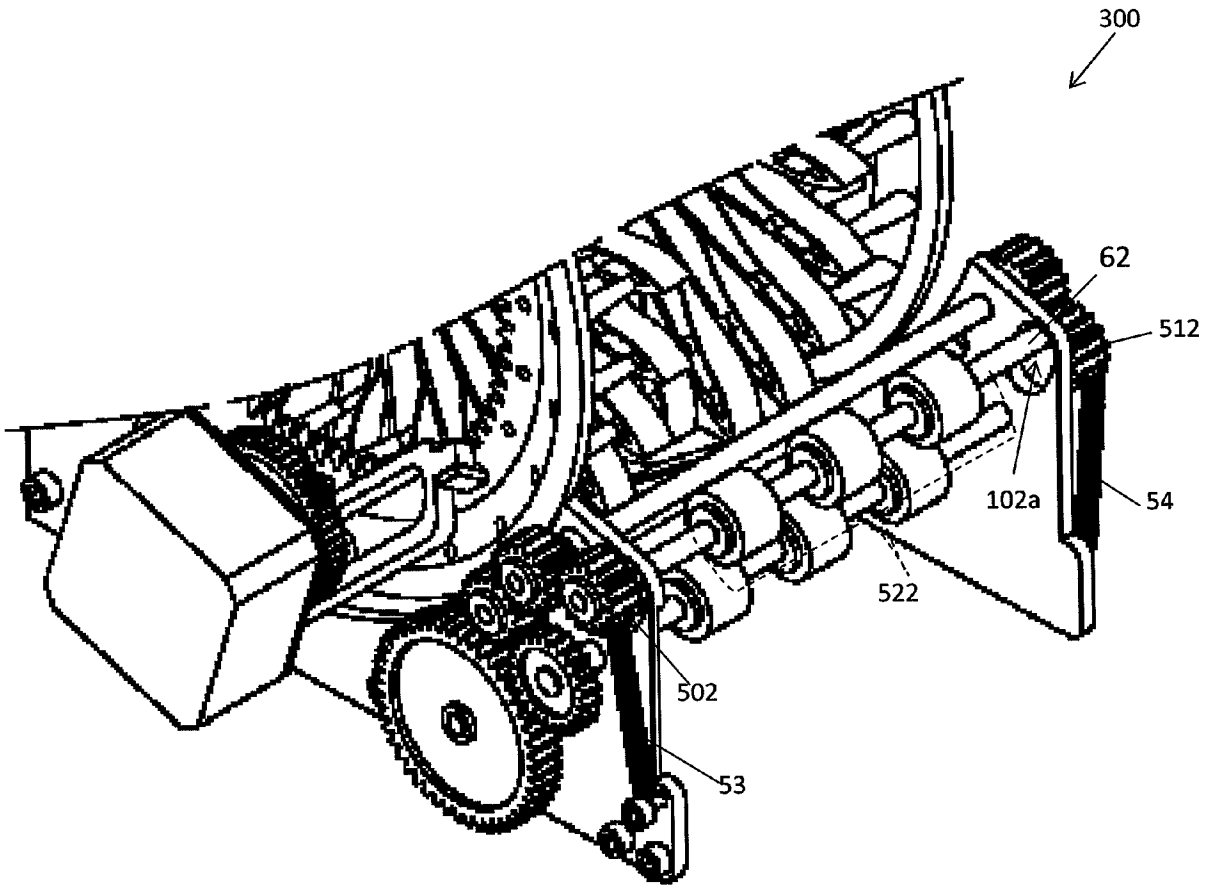

FIGS. 6A and 6B are perspective views of the card output device 300 as illustrated in FIG. 1 in accordance with an example of the present invention. Referring to FIG. 6A, the card output device 300 may include two gear assemblies 50 and 51, a roller assembly 52 associated with the gear assemblies 50 and 51 and a pair of resilient elements 53 and 54.

The gear assembly 50 may include at least five gears each of which may be rotatably mounted to the side wall 101 of the base 10. The gears of the gear assembly 50 may be engaged with one another. The gear assembly 51 may include at least two gears each of which may be rotatably mounted to the side wall 102 of the base 10. The gears of the gear assembly 51 may be engaged with each other. Furthermore, the gear 501 of the gear assembly 50 may be coupled to the gear 511 of the gear assembly 51 through a shaft 61.

A hole 101*a* may be formed in the side wall 101 and a hole 102*a* may be formed in the side wall 102. The roller assembly 52 may include at least two sets of rollers 521 and 522. The set of rollers 521 may be rotatably mounted between the side walls 101 and 102 and coupled to the gear 503. Furthermore, the set of rollers 522 may be coupled to the gears 502 and 512 through a shaft 62. The shaft 62, which may pass through the holes 101*a* and 102*a*, may be coupled to the side walls 101 and 102 through the resilient elements 53 and 54 respectively.

Figure 6C:
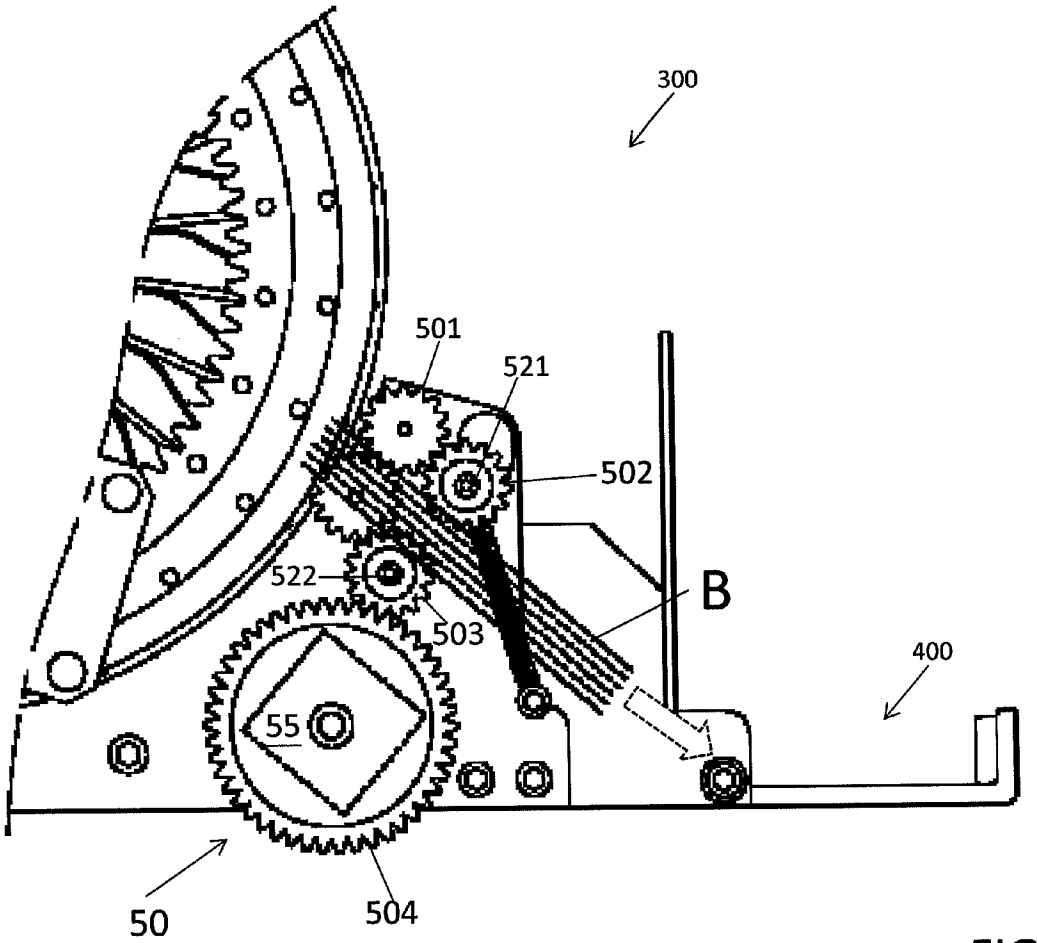
FIG. 6C and FIG. 6D are two opposite side views of the card output device and the card receiver as illustrated in FIG. 1 in accordance with an example of the present invention
Figure 6D:
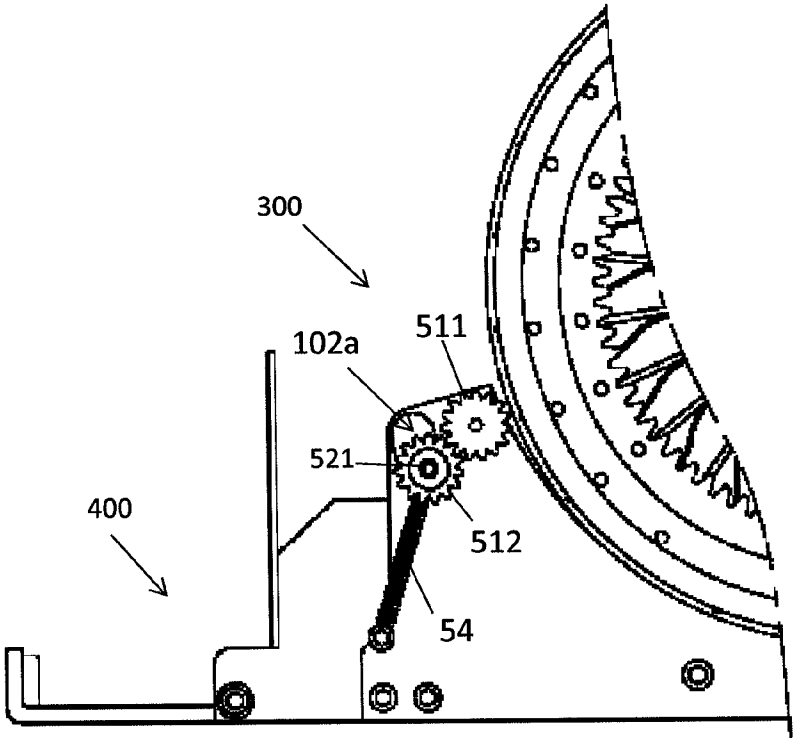

FIG. 6C and FIG. 6D are two opposite side views of the card output device 300 and the card receiver 400 as illustrated in FIG. 1 in accordance with an example of the present invention. Referring to FIG. 6C, the gear 504 may be coupled to and driven by a motor 55 to serve as a driving gear, which may drive other gears of the gear assembly 50. As the driving gear 504 rotates counterclockwise, the gear 503 may be driven to rotate clockwise, while the gear 502 may be driven to rotate counterclockwise. Accordingly, the sets of rollers 522 and 521, which may be driven by the gears 503 and 502 respectively, may be adapted to transmit the discharged cards B towards the card receiver 400. Referring to FIG. 6D, the gear 511 may be coupled to the gear 501 through the shaft 61 and the gear 512 may be engaged with the gear 511.

Figure 6E:
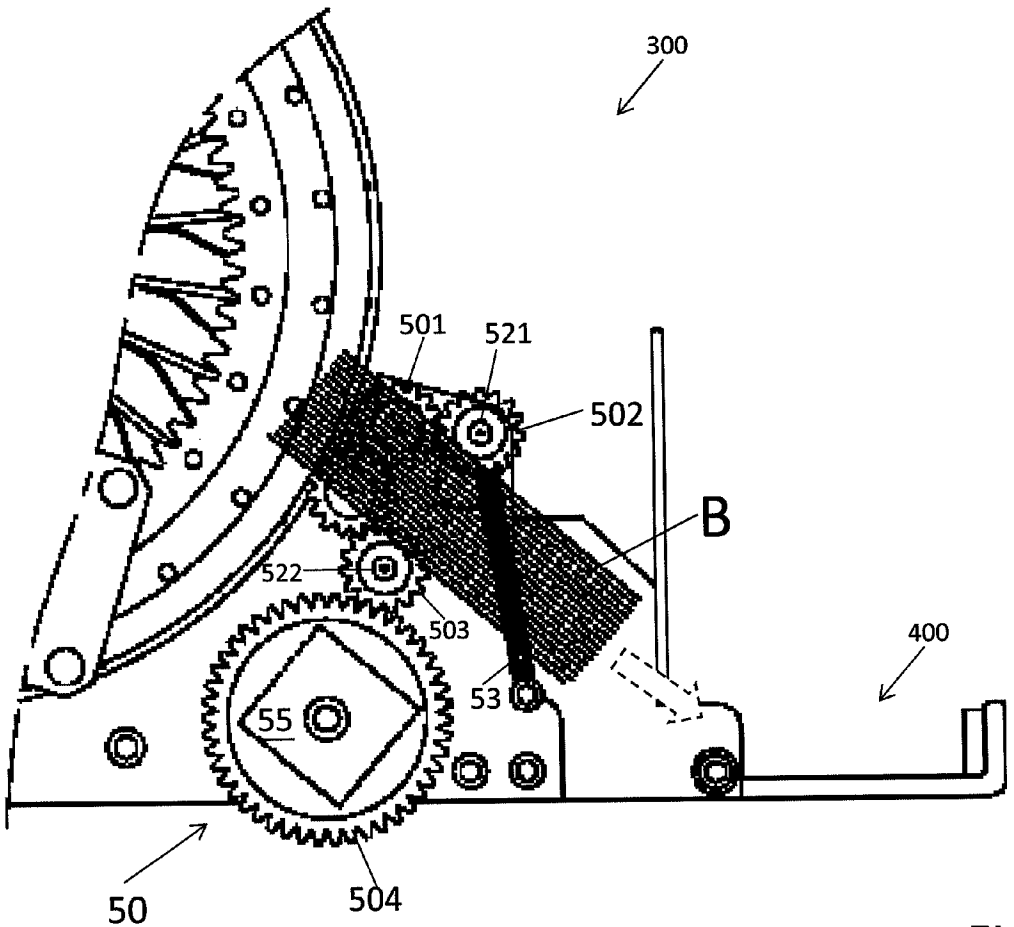
FIG. 6E and FIG. 6F are two opposite side views of the card output device and the card receiver as illustrated in FIG. 1 in accordance with another example of the present invention.
Figure 6F:
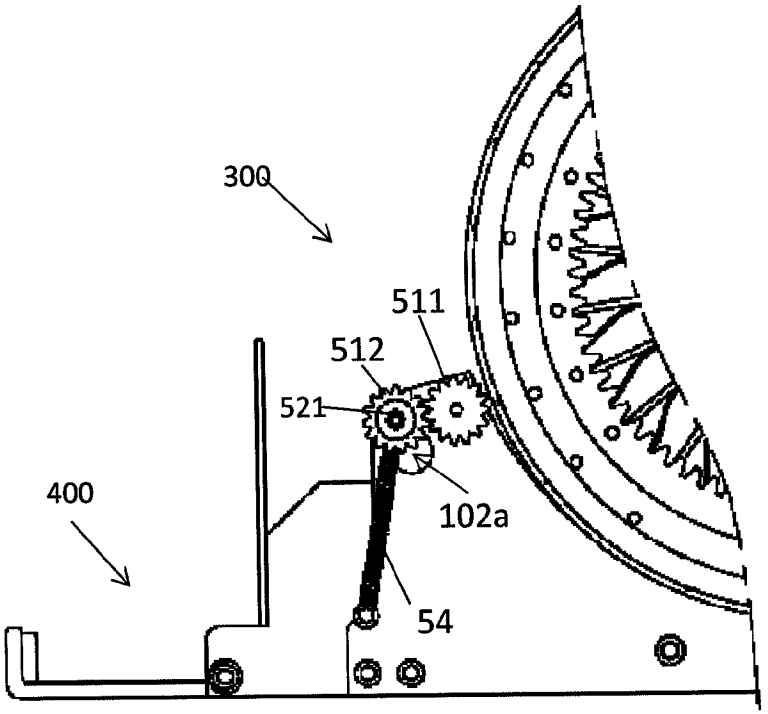

FIG. 6E and FIG. 6F are two opposite side views of the card output device 300 and the card receiver 400 as illustrated in FIG. 1 in accordance with another example of the present invention. Referring to FIG. 6E, as the discharged cards B are greater in number, the set of rollers 521 may move upwards so as to change the space between the sets of rollers 521 and 522 to allow such the cards B to go through. Specifically, the holes 101*a* and 102*a* may be designed so that when the set of rollers 521 moves upwards together with the gear 502, the gear 502 may be still engaged with the gear 501. Referring to FIG. 6F, as the set of rollers 521 moves upwards together with the gear 512, the gear 512 may be still engaged with the gear 511. Accordingly, the card output device 300 of the present invention may be adapted to output different numbers of cards.

Figure 7:
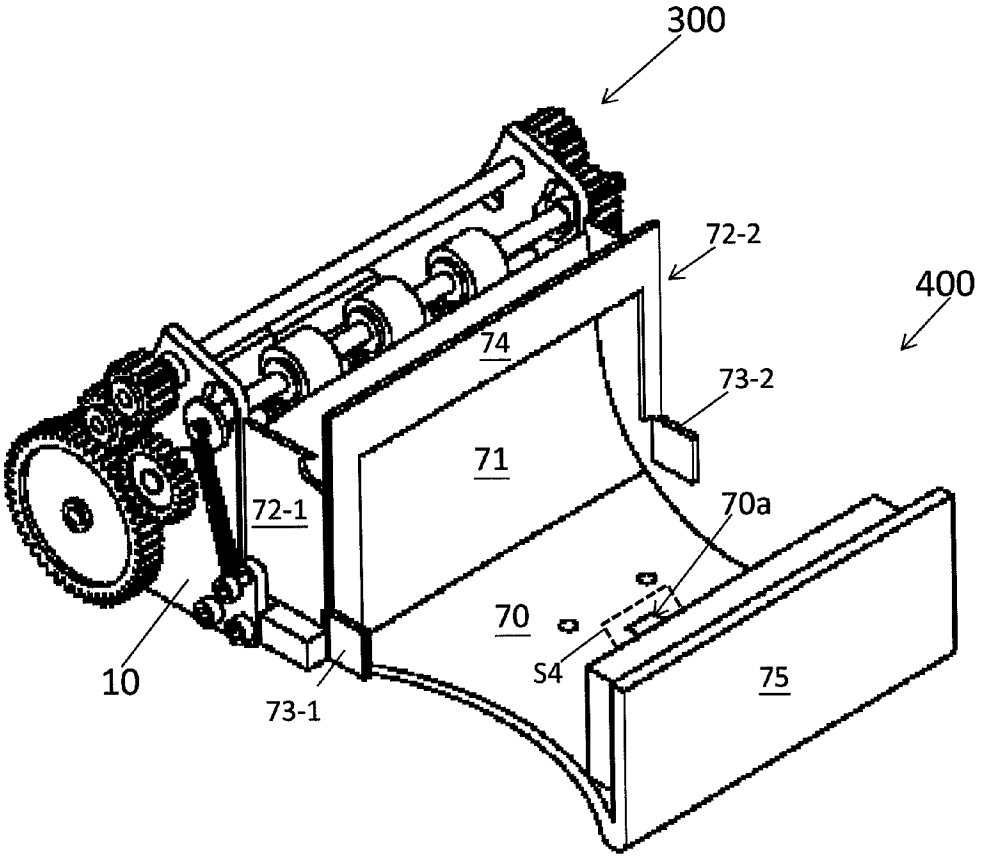
FIG. 7 is a perspective view of the card output device and the card receiver as illustrated in FIG. 1 in accordance with an example of the present invention.

FIG. 7 is a perspective view of the card output device 300 and the card receiver 400 as illustrated in FIG. 1 in accordance with an example of the present invention. Referring to FIG. 7, the card receiver 400 may be detachably mounted to the base 10 adjacent to the card output device 300. The card receiver 400 may be adapted to receive cards B transmitted from the card output device 300.

Specifically, the card receiver 400 may include a bottom plate 70, a back plate 71, a pair of side walls 72-1 and 72-2, a pair of side stops 73-1 and 73-2, a blocking bracket 74 and a front stop 75. The bottom plate 70 may be detachably mounted to the base 10 and the back plate 71 may be extended from the bottom plate 70. In the present example, the back plate 71 may have an arc shape but may be changed or varied in other examples. Furthermore, the side walls 72-1 and 72-2 may be extended from the back plate 71. The side stops 73-1 and 73-2 may be extended from the side walls 72-1 and 72-2 respectively, and the blocking bracket 74 may be mounted to the side stops 73-1 and 73-2.

The cards B transmitted from the card output device 300 may slide on the back plate 71 and down to and stay on the bottom plate 70. A sensor S4 may be disposed on the lower surface of the bottom plate 70. The sensor S4 may be exposed by a hole 70*a* formed in the bottom plate 70, and the cards B which may stay on the bottom plate 70 may be detected by the sensor S4. Furthermore, the pair of side walls 72-1 and 72-2 may be adapted to restrain the cards B from going out of the card receiver 400. The pair of side stops 73-1 and 73-2 and the front stop 75 may be adapted to hold the cards B on the bottom plate 70.

Figure 8A:
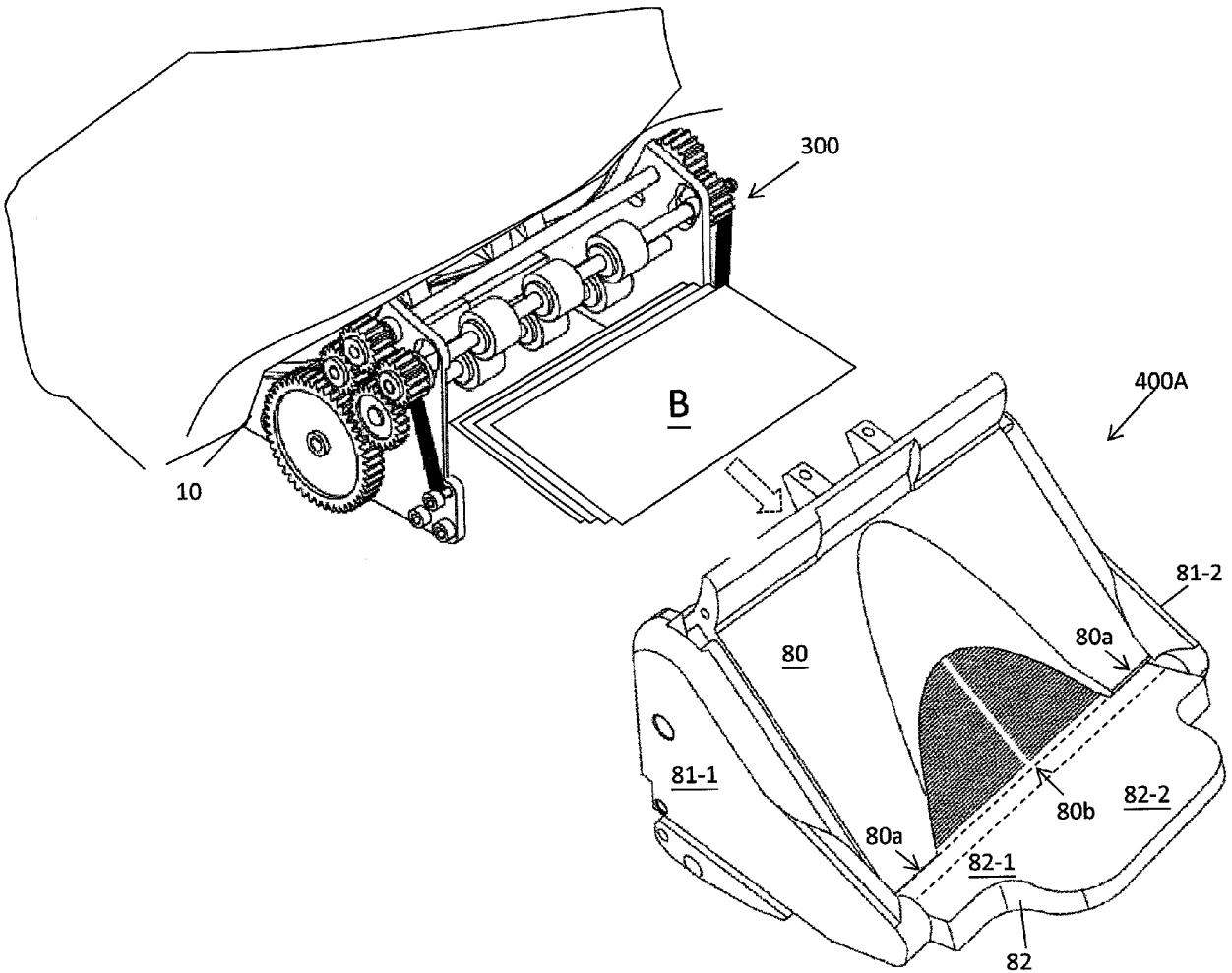
FIG. 8A is a perspective view of the card output device and a card receiver in accordance with another example of the present invention.

FIG. 8A is a perspective view of the card output device 300 and a card receiver 400A in accordance with another example of the present invention. Referring to FIG. 8A, the card receiver 400A which may replace the card receiver 400 as shown in FIG. 7, may be dedicated for the poker games of "black jack" or "baccarat." The card receiver 400A may be detachably mounted to the base 10 and disposed adjacent to the card output device 300. Cards B from the card output device 300 may be transmitted to and accommodated in the card receiver 400A. The card receiver 400A may include a top plate 80, a pair of side walls 81-1 and 81-2, a bottom plate 82 and a movable component 83 (not shown in FIG. 8A). The bottom plate 82 may be securely mounted between the pair of side walls 81-1 and 81-2, and the top plate 80 may be detachably mounted between the pair of side walls 81-1 and 81-2. Specifically, the bottom plate 82 may include a first portion 82-1 and a second portion 82-2. The second portion 82-2 may be extended from the first portion 82-1, and the width of the first portion 82-1 may be greater than the width of the second portion 82-2. Furthermore, the top plate 80 may be slantwise arranged with respect to the bottom plate 82 and arranged to leave a space 80*b* (illustrated with two dotted lines) between the lower edge 80*a* of the top plate 80 and the first portion 82-1 the bottom plate 82.

Figure 8B:
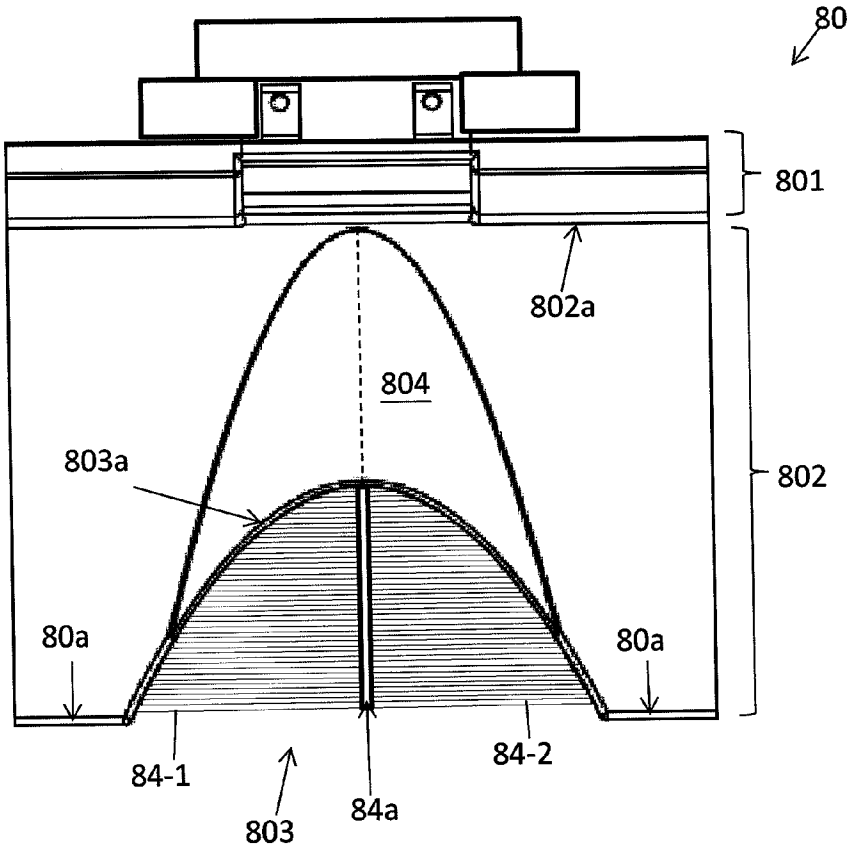
FIG. 8B is a front view of the top plate as illustrated in FIG. 8A in accordance with an example of the present invention.

FIG. 8B is a front view of the top plate 80 as illustrated in FIG. 8A in accordance with an example of the present invention. Referring to FIG. 8B, the top plate 80 may include a first portion 801 and a second portion 802. The first portion 801 may be extended from the upper edge 802*a* of the second portion 802. Furthermore, the top plate 80 may include an open 803 formed in the center part of the second portion 802. The open 803 may be extended to the lower edge 80*a* of the top plate 80. In the present example, the open 803 may have a semicircular shape. In another example, the open 803 may have a rectangular shape. Moreover, a recess 804 may be formed in the center part of the second portion 802. The recess 804 may be extended from the upper edge 803*a* of the open 803 to the upper edge 802*a* of the second portion 802. In the present example, the recess 804 may have a shape define by two arcs, wherein one of the arcs is a portion of the upper edge 803*a* of the open 803.

Thanks to the arrangement of the open 803, cards B accommodated in the card receiver 400A may be captured through the space 80*b* between the top plate 80 and the bottom plate 82. In addition, the recess 804 may facilitate the capturing of the cards B.

Figure 8C:
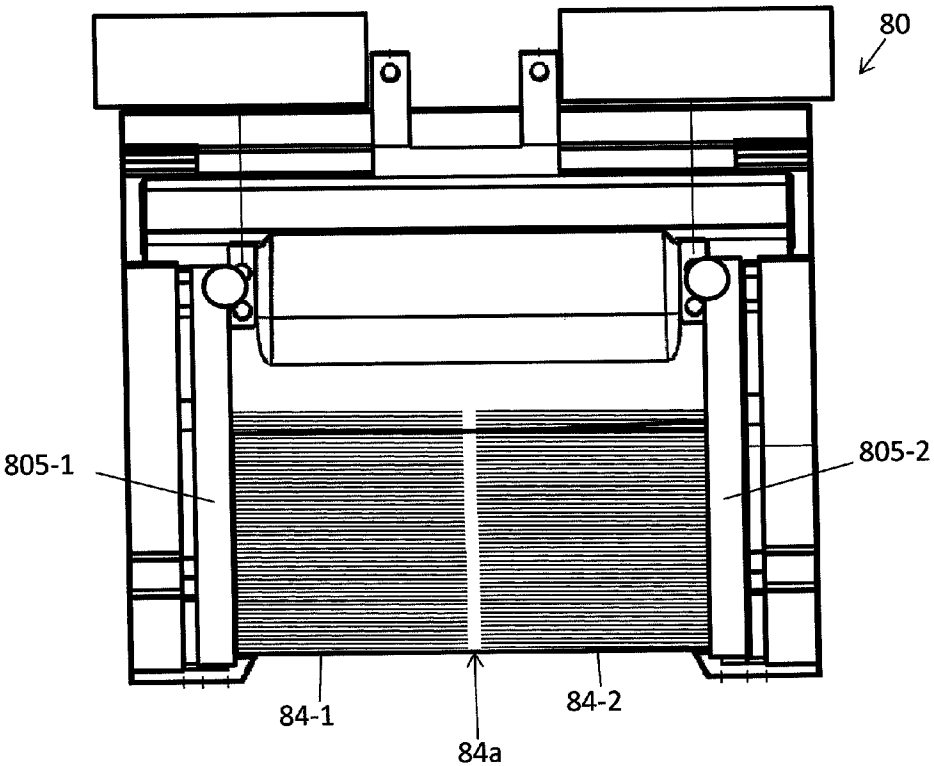
FIG. 8C is a rear view of the top plate as illustrated in FIG. 8B in accordance with an example of the present invention.

FIG. 8C is a rear view of the top plate 80 as illustrated in FIG. 8B in accordance with an example of the present invention. Referring to FIG. 8C, a pair of brushes 84-1 and 84-2 may be detachably mounted to the back side of the top plate 80 through a pair of connecting mechanism 805-1 and 805-2 respectively. The pair of brushes 84-1 and 84-2 may be arranged in a symmetric manner and arranged to leave a space 84*a* there-between. Referring back to FIG. 8B, the pair of brushes 84-1 and 84-2 may be exposed by the open 803, and the space 84*a* between the pair of brushes 84-1 and 84-2 may be aligned with a central line (illustrated with a dotted line) of the recess 804. Thanks to the arrangements of the pair of brushes 84-1 and 84-2, cards B accommodated in the card receiver 400A may be hardly visible.

Figure 8D:
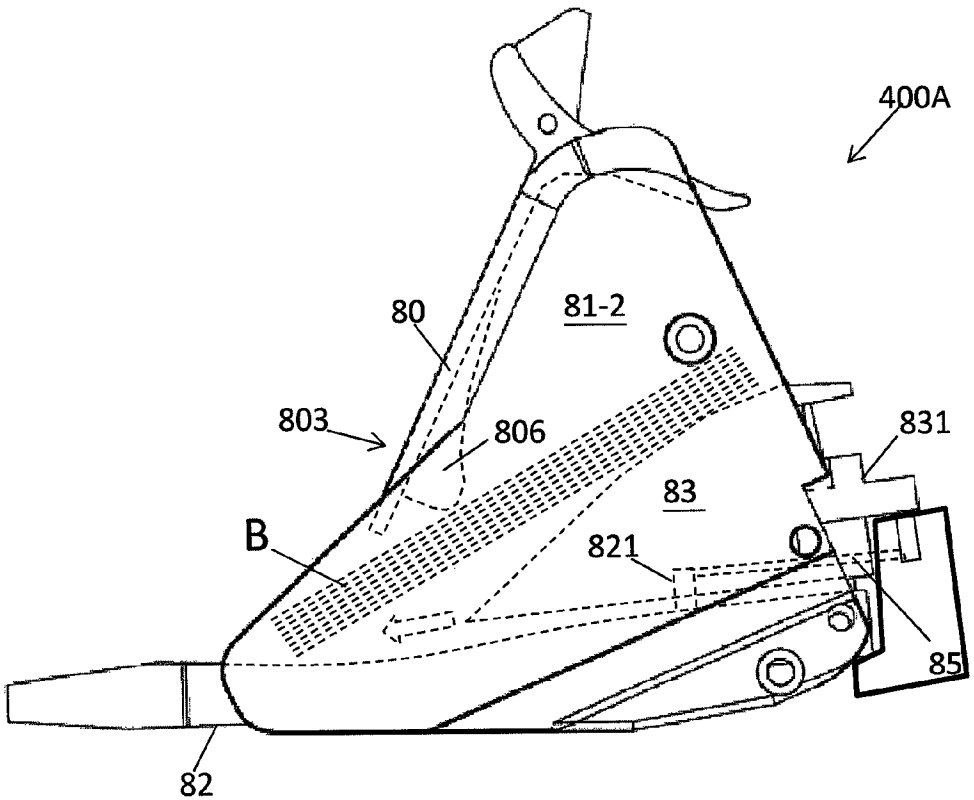
FIG. 8D is a left side view of the card receiver as illustrated in FIG. 8A in accordance with an example of the present invention.

FIG. 8D is a left side view of the card receiver 400A as illustrated in FIG. 8A in accordance with an example of the present invention. Referring to FIG. 8D, the movable component 83 may be disposed among the pair of side walls 81-1 and 81-2, the top plate 80 and the bottom plate 82. The movable component 83 may include a protrusion 831, and a resilient component 85 may be secured to the protrusion 831 and a protrusion 821 formed on the bottom plate 82. Therefore, resilient force of the resilient component 85 may apply on the movable component 83 and the bottom plate 82. Thanks to the resilient force of the resilient component 85, as the cards B transmitted from the card output device 300 are accommodated on the movable component 83, the movable component 83 may be adapted to push the cards B towards the top plate 80 so that the cards B may be in contact with the bottom plate 82 and a pair of protrusions 806 formed on the top plate 80. Thereby, the cards B may be tightly held in the card receiver 400A.

Figure 8E:
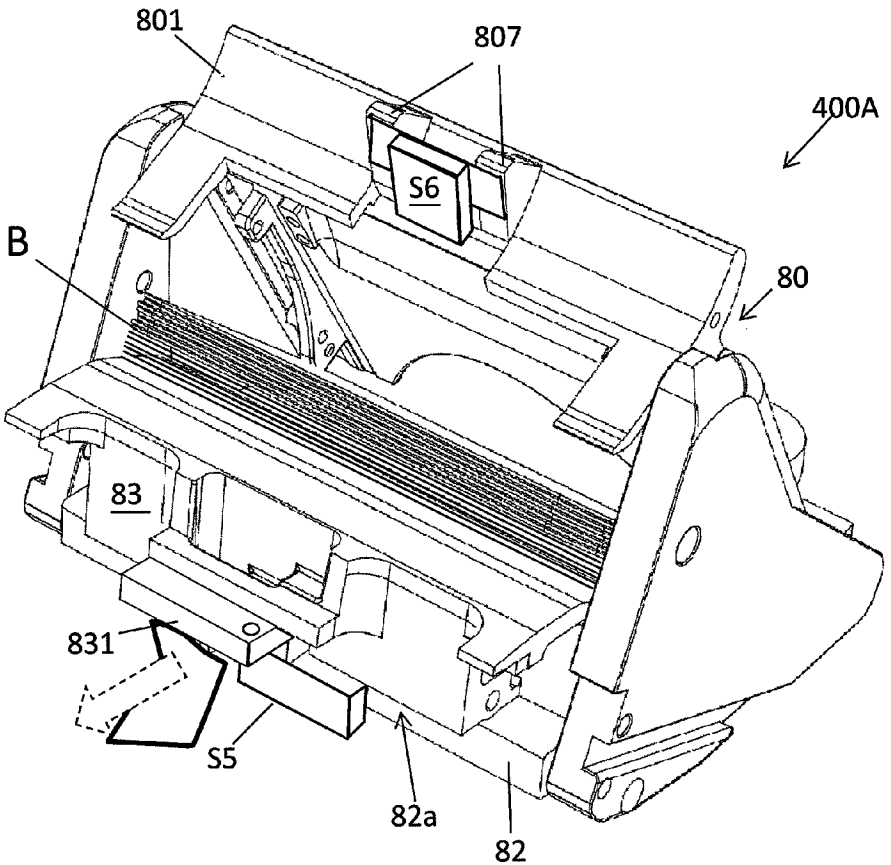
FIGS. 8E and 8F are other perspective views of the card receiver from a different angle as illustrated in FIG. 8A in accordance with an example of the present invention.
Figure 8F:
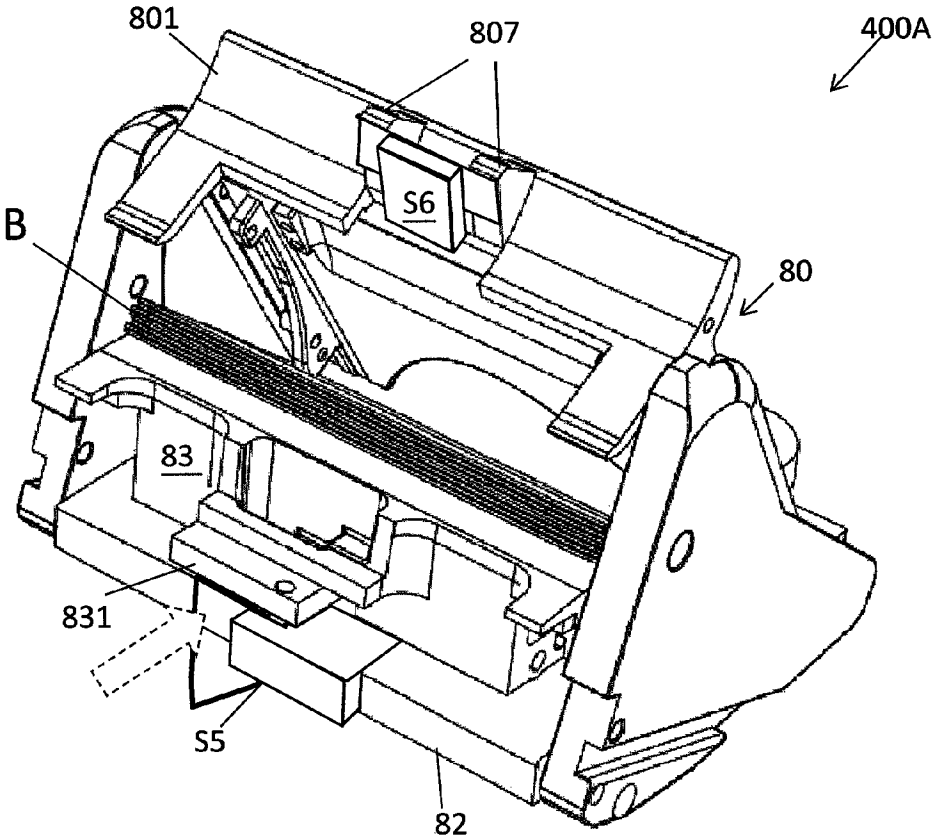

FIGS. 8E and 8F are other perspective views of the card receiver 400A from a different angle as illustrated in FIG. 8A in accordance with an example of the present invention. Referring to FIG. 8E, a sensor S5 may be disposed on the bottom plate 82 close to the back edge 82*a* thereof. In operation, as the cards B are accommodated on the movable component 83, the movable component 83 may be moved away from the top plate 80, and the protrusion 831 of the movable component 83 may be detected by the sensor S5. Referring to FIG. 8F, as some of the cards B are captured out of the card receiver 400A, the thickness of the cards B may be decreased and the movable component 83 may thus be moved towards the top plate 80. Furthermore, as the cards B are completely captured out of the card receiver 400A, the movable component 83 may be moved to a position at which the protrusion 831 may not be detected by the sensor S5. Meanwhile, the shuffling device 200 may be informed and configured to discharge cards to the card out device 300. The discharged cards may then be transmitted to and accommodated in the card receiver 400A.

A sensor S6 may be disposed on a pair of protrusions 807 formed on the first portion 801 of the top plate 80. As the shuffling machine 1 initially powers on, the sensor S6 may be configured to detect whether any cards are accommodated in the card receiver 400A. If confirmative, the shuffling machine 1 may be informed and configured to remove all the cards accommodated in the card receiver 400A. Then, the shuffling machine 1 may be configured to perform an initial set-up procedure, which may include configuring the shuffling wheel 41 to rotate to an original position.

Figure 9:
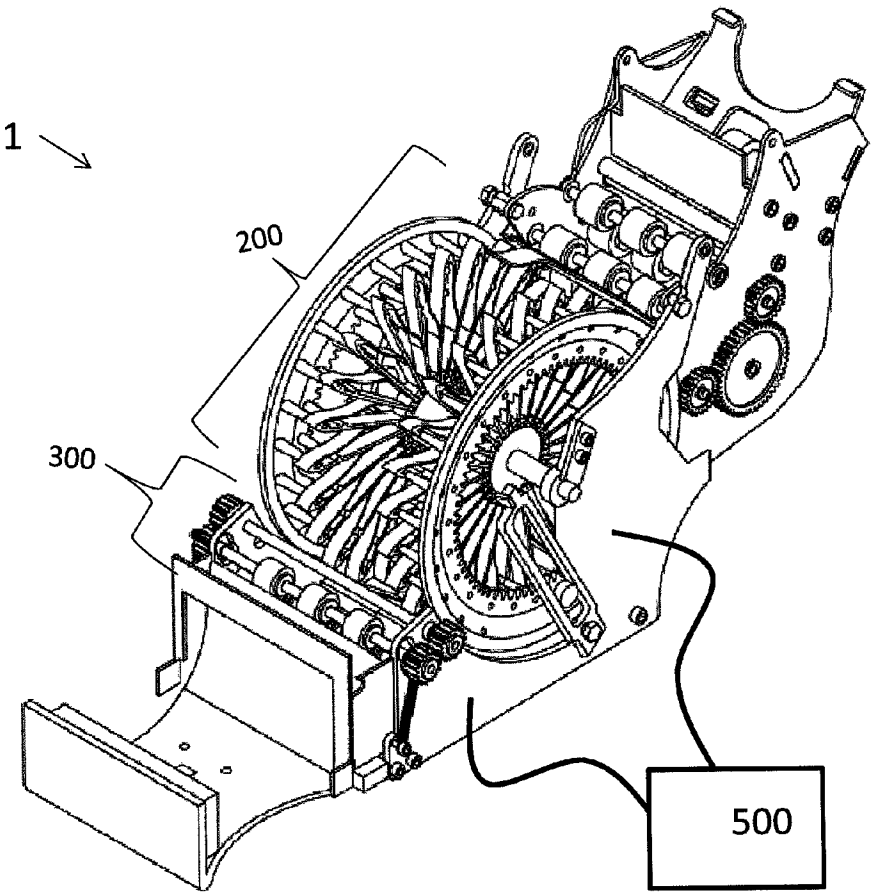
FIG. 9 is a schematic diagram of the shuffling machine in accordance with an example of the present invention.

FIG. 9 is a schematic diagram of the shuffling machine 1 in accordance with an example of the present invention. Referring to FIG. 9, the shuffling device 200 and the card output device 300 may be electrically coupled to a controller 500. The controller 500 may be programmed or configured to automatically control the shuffling machine 1

Figure 10A:
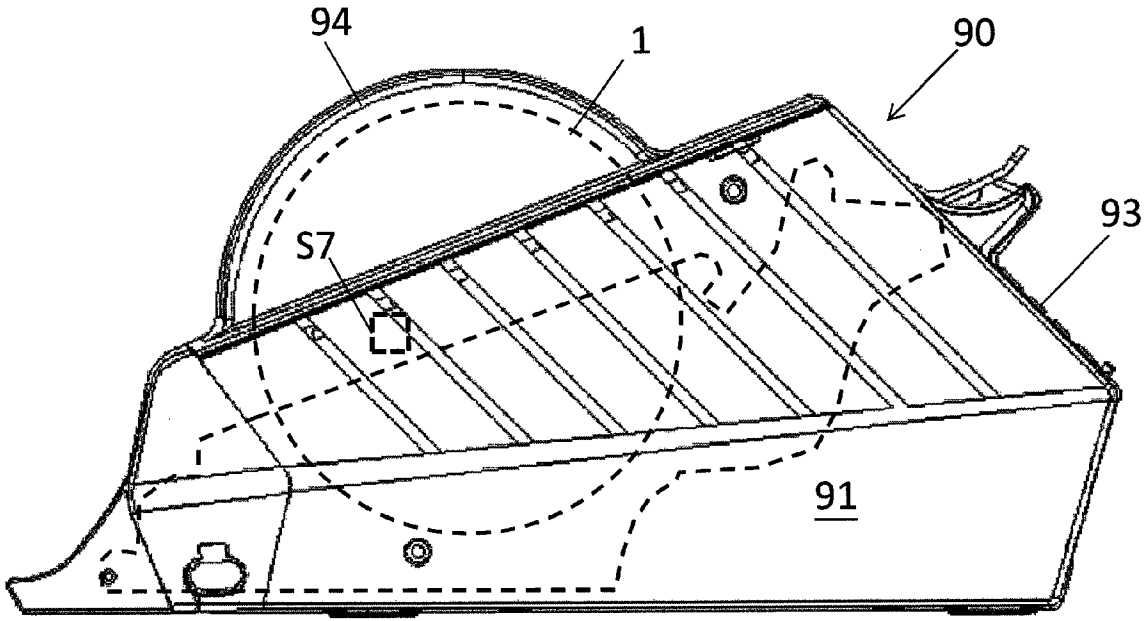
FIG. 10A is a left side view of the shuffling machine disposed within a case in accordance with another example of the present invention.
Figure 10B:
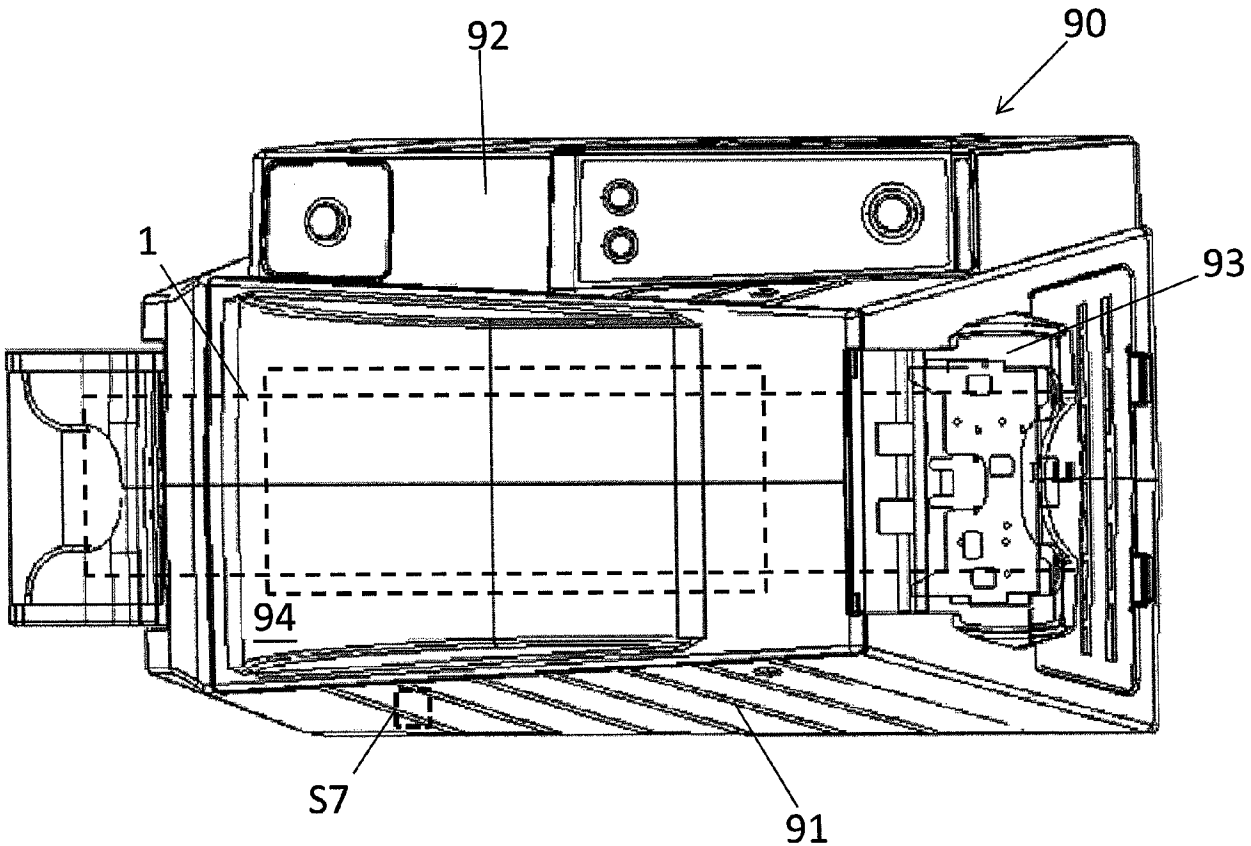
FIG. 10B is a top view of the shuffling machine disposed within a case in accordance with another example of the present invention.

FIG. 10A is a left side view and FIG. 10B is a top view of the shuffling machine 1 disposed within a case 90 in accordance with another example of the present invention. Referring to FIGS. 10A and 10B, in the present example, the shuffling machine 1 (illustrated with dotted line) may be disposed within the case 90. The case 90 may include a left side wall 91, a right side wall 92, a front cover 93 and a top cover 94, wherein the top cover 94 may be opened. Furthermore, a sensor S7 may be disposed on the inner surface of the left side wall 91. The sensor S7 may be configured to detect whether the top cover 94 is opened.

It will be appreciated by those skilled in the art that changes could be made to the examples described above without departing from the broad inventive concept thereof. It is understood, therefore, that this invention is not limited to the particular examples disclosed, but it is intended to cover modifications within the spirit and scope of the present invention as defined by the appended claims.

Further, in describing representative examples of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

I claim:

1. A card output device of a shuffling machine, the device comprising:

a base comprising:

a first and a second side walls, a roller assembly rotatably mounted between the first and second side walls of the base, the roller assembly comprising:

a first set of rollers; and a second set of rollers arranged over the first set of rollers, the second set of rollers being moved upwards and downwards between the first and second side walls of the base, a first gear assembly rotatably mounted on the first side wall of the base, the first gear assembly comprising:

a first gear coupled to the first set of rollers;

a second gear coupled to the second set of rollers;

a third gear engaged with the first gear; and a fourth gear engaged with the second gear and the third gear. and a second gear assembly rotatably mounted on the second side wall of the base, the second gear assembly comprising:

a first gear coupled to the fourth gear of the first gear assembly; and a second gear engaged with the first gear and coupled to the second set of rollers.

2. The device of claim 1, wherein the fourth gear of the first gear assembly is coupled with the first gear of the second gear assembly through a first shaft.

3. The device of claim 2, wherein the second gear of the first gear assembly and the second gear of the second gear assembly are coupled to the second set of rollers through a second shaft.

4. The device of claim 3, wherein the roller assembly further comprises a pair of bearings disposed on the second shaft, the pair of bearings slidably fit a pair of holes formed in the first and second side walls of the base respectively.

5. The device of claim 4 further comprising a pair of resilient elements, the second shaft is coupled to the first and second side walls of the base through the pair of resilient elements respectively.

6. The device of claim 5, wherein the second set of rollers are moved upwards and downwards along the pair of holes through the second shaft and the pair of bearings.

7. A card output device of a shuffling machine, the device comprising:

a base comprising:

a first and a second side walls, a roller assembly rotatably mounted between the first and second side walls of the base, the roller assembly comprising:

a first set of rollers; and a second set of rollers arranged over the first set of rollers, the second set of rollers being moved upwards and downwards between the first and second side walls of the base, and a receiver detachably mounted to the base.

8. The device of claim 7 further comprising:

a first gear assembly rotatably mounted on the first side wall of the base, the first gear assembly comprising:

a first gear coupled to a motor mounted to the first side wall of the base;

a second gear engaged with the first gear, the second gear being coupled to the first set of rollers;

a third gear engaged with the second gear;

a fourth gear engaged with the third gear; and a fifth gear engaged with the fourth gear, the fifth gear being coupled to the second set of rollers.

9. The device of claim 8 further comprising:

a second gear assembly rotatably mounted on the second side wall of the base, the second gear assembly comprising:

a first gear coupled to the fourth gear of the first gear assembly; and a second gear engaged with the first gear and coupled to the second set of rollers.

10. The device of claim 9, wherein the first gear of the second gear assembly is coupled to the fourth gear of the first gear assembly through a first shaft.

11. The device of claim 10, wherein the fifth gear of the first gear assembly and the second gear of the second gear assembly are coupled to the second set of rollers through a second shaft.

12. The device of claim 11, wherein the roller assembly further comprises a pair of bearings disposed on the second shaft, the pair of bearings slidably fit a pair of holes formed in the first and second side walls of the base respectively.

13. The device of claim 12 further comprising a pair of resilient elements, the second shaft is coupled to the first and second side walls of the base through the pair of resilient elements respectively.

14. The device of claim 13, wherein the second set of rollers are moved upwards and downwards along the pair of holes through the second shaft and the pair of bearings.

15. A card output device of a shuffling machine, the device comprising:

a base comprising:

a first and a second side walls, a roller assembly rotatably mounted between the first and second side walls of the base, the roller assembly comprising:

a first set of rollers; and a second set of rollers arranged over the first set of rollers, the second set of rollers being moved upwards and downwards between the first and second side walls of the base, a first gear assembly rotatably mounted on the first side wall of the base, the first gear assembly comprising:

a first gear coupled to the first set of rollers;

a second gear coupled to the second set of rollers;

a third gear engaged with the first gear; and a fourth gear engaged with the second gear and the third gear.

a second gear assembly rotatably mounted on the second side wall of the base, the second gear assembly comprising:

a first gear coupled to the fourth gear of the first gear assembly; and a second gear engaged with the first gear and coupled to the second set of rollers, and a receiver detachably mounted to the base.

16. The device of claim 15, wherein the receiver comprises:

a pair of side walls;

a top plate detachably mounted between the pair of side walls;

a bottom plate securely mounted between the pair of side walls; and a movable component disposed among the pair of side walls, the top plate and the bottom plate.

17. The device of claim 16, wherein the top plate is slantwise arranged with respect to the bottom plate.

18. The device of claim 17, wherein the top plate comprises an open formed in the center part of the top plate, the open is extended to the lower edge of the top plate.

19. The device of claim 18, wherein the top plate further comprises a recess formed in the center part of the top plate, the recess is extended from the upper edge of the open towards the upper edge of top plate.

20. The device of claim 19, wherein the top plate further comprises a pair of brushes detachably mounted to the back side of the top plate, the pair of brushes are arranged in a symmetric manner.

21. The device of claim 20, wherein the pair of brushes are exposed by the open, and a space between the pair of brushes is aligned with the center of the recess.

22. The device of claim 21, wherein the movable component is coupled to the bottom plate through a resilient component, the movable component moves towards or away from the top plate.

* * * * *